US005604575A

United States Patent [19]

Takagaki et al.

[11] Patent Number: 5,604,575

[45] Date of Patent: *Feb. 18, 1997

[54] IMAGE FORMING APPARATUS WITH TONER RECYCLING DEVICE

[75] Inventors: Hiromitsu Takagaki, Yokohama; Shinji Kato, Kawasaki; Hisao Murayama; Shigeru Watanabe, both of Yokohama; Mayumi Yoshida, Tokyo; Shunji Kato, Sagamihara, all of Japan

[73] Assignee: Ricoh Company, Ltd., Tokyo, Japan

[ * ] Notice: The term of this patent shall not extend beyond the expiration date of Pat. No. 5,493,382.

[21] Appl. No.: 441,612

[22] Filed: May 15, 1995

Related U.S. Application Data

[63] Continuation of Ser. No. 44,394, Apr. 8, 1993, Pat. No. 5,493,382.

[30] Foreign Application Priority Data

| | | | |
|---|---|---|---|
| Apr. 11, 1992 | [JP] | Japan | 4-118374 |
| May 3, 1992 | [JP] | Japan | 4-139790 |
| Jul. 23, 1992 | [JP] | Japan | 4-217189 |
| Aug. 13, 1992 | [JP] | Japan | 4-237693 |
| Feb. 22, 1993 | [JP] | Japan | 5-56566 |

[51] Int. Cl.[6] ..... G03G 21/10

[52] U.S. Cl. ..... 399/359; 399/53

[58] Field of Search ..... 355/296, 298, 355/246, 208; 118/652

[56] References Cited

U.S. PATENT DOCUMENTS

| | | | |
|---|---|---|---|
| 4,377,334 | 3/1983 | Nishikawa | 355/298 X |
| 4,768,055 | 8/1988 | Takamatsu et al. | 355/298 X |
| 4,894,688 | 1/1990 | Taniguchi et al. | 355/298 |
| 4,996,538 | 2/1991 | Brecy et al. . | |
| 5,107,302 | 4/1992 | Bisaiji | 355/246 |
| 5,200,787 | 4/1993 | Nishiguchi | 355/298 |

FOREIGN PATENT DOCUMENTS

| | | | |
|---|---|---|---|
| 476716 | 3/1992 | European Pat. Off. . | |
| 57-024971 | 2/1982 | Japan . | |
| 57-161770 | 10/1982 | Japan | 355/298 |
| 59-148080 | 8/1984 | Japan | 355/298 |
| 60-041079 | 3/1985 | Japan | 355/298 |
| 60-057365 | 4/1985 | Japan . | |
| 63-138381 | 6/1988 | Japan . | |
| 03153271 | 7/1991 | Japan . | |

*Primary Examiner*—Robert Beatty

*Attorney, Agent, or Firm*—Oblon, Spivak, McClelland, Maier & Neustadt, P.C.

[57] ABSTRACT

An image forming apparatus capable of collecting a toner remaining on an image carrier after image transfer and conveying the collected toner to a developing unit to reuse it. A toner supplement roller and a toner conveyor are so controlled as to maintain the supplement of a fresh toner from a hopper to the developing unit and the supplement of the collected toner from the toner conveyor to the developing unit in a ratio lying in a predetermined range.

6 Claims, 29 Drawing Sheets

Fig. 2B

| P SENSOR LEVEL | $V_{SP}$ (V) | $V_{SP}/V_{SG}$(%) | TONER SUPPLEMENT TIME | TONER TRANSPORT SECTION DRIVE TIME |
|---|---|---|---|---|
| HIGH CONCENTRATION | 0 ~ 0.5 | 0 ~ 12.5 | STOP TONER SUPPLEMENT | ← |
| SUPPLEMENT LEVEL 1 | 0.51~0.6 | 12.6~15.0 | SET P MODE SUPPLEMENT RATE | ← |
| SUPPLEMENT LEVEL 2 | 0.61~0.7 | 15.1 ~ 17.5 | TWICE SET P MODE SUPPLEMENT RATE | ← |
| SUPPLEMENT LEVEL 3 | 0.71~1.6 | 17.6~25.6 | FOUR TIMES P MODE SUPPLEMENT RATE | ← |
| TONER END SUPPLEMENT | 1.01~2.49 | 25.1~62.4 | INCREASE SUPPLEMENT LEVEL TO 1, 2 & 3; FINALLY AT LEVEL 3 | STOP |

| Vsp / Vsg | COLLECTED TONER SUPPLEMENT TIME | FRESH TONER SUPPLEMENT TIME |
|---|---|---|
| Vsp / Vsg < 0.05 | 0 | 0 |
| Vsp / Vsg < 0.08 | 0.1 | 0 |
| Vsp / Vsg ≦ 0.10 | 0.8 | 0 |
| Vsp / Vsg < 0.17 | 0.2 | 0.9 |
| Vsp / Vsg < 0.25 | 0 | 2.0 |

| Fig. 15A | Fig. 15B |
|---|---|

| Vsp / Vsg | COLLECTED TONER SUPPLEMENT TIME | FRESH TONER SUPPLEMENT TIME |
|---|---|---|
| Vsp / Vsg < 0.05 | 0 | 0 |
| Vsp / Vsg < 0.08 | 0.2 | 0 |
| Vsp / Vsg ≦ 0.10 | 0.8 | 0 |
| Vsp / Vsg < 0.17 | 0.6 | 0.7 |
| Vsp / Vsg < 0.25 | 0.25 | 1.8 |

IMAGE FORMING APPARATUS WITH TONER RECYCLING DEVICE

This is a Continuation of application Ser. No. 08/044,394 filed on Apr. 8, 1993, now U.S. Pat. No. 5,493,382.

BACKGROUND OF THE INVENTION

The present invention relates to a copier, facsimile apparatus, printer or similar image forming apparatus and, more particularly, to an image forming apparatus capable of collecting a toner remaining on an image carrier after image transfer and conveying the collected toner to a developing unit to reuse it.

It is a common practice with the above-described type of image forming apparatus to electrostatically form a latent image on an image carrier, develop the latent image by a toner to produce a corresponding toner image, transfer the toner image to a paper sheet or similar transfer medium, and then fix the toner image on the medium. In this kind of image forming process, while a majority of the toner deposited on the latent image is transferred to and consumed by the transfer medium, the other toner is left untranferred on the image carrier and collected by cleaning means. The manner in which the toner is to remain on the image carrier is susceptible to ambient conditions. For example, in a hot and humid environment, the image transfer efficiency is lowered to cause a greater amount of toner to remain on the image carrier. A small amount of toner is also deposited in the areas of the image carrier other than the image forming area and collected by the cleaning means. Further, a toner image representative of a reference density pattern which implements toner concentration control or similar process control is also left untransferred on the image carrier and collected by the cleaning means.

To use the toner collected by the cleaning means effectively, there has been proposed an image forming apparatus of the type conveying the collected toner from the cleaning means to developing means, as disclosed in Japanese Utility Model Laid-Open Publication No. 166264/1984 by way of example (referred to as Prior Art 1 hereinafter). Specifically, the collected toner is transported to and supplemented from above an unused or fresh toner existing in the developing section of the developing means or is transported to a toner storing section included in the developing means and mixed with a fresh toner there. The position where the developing means receives the collected toner depends on the type of the apparatus. For example, the apparatus may receive the collected toner in the vicinity of a developing roller present in the developing section or receive it in the toner storing section. It has also been proposed to omit the cleaning means and assign the cleaning function also to the developing means.

However, the problem with the collected toner is that the physical property thereof changes before reuse, compared to a fresh toner. For example, the collected toner contains paper dust and other impurities and has the particle size thereof reduced. Moreover, the collected toner has the frictional chargeability thereof lowered by the repetitive transfer charge and has the fluidity or pulverulent characteristic thereof degraded. In this condition, when the collected toner and fresh toner are mixed in the developing means, it is difficult to maintain the toner concentration uniform and the toner charge stable. In light of the above, Japanese Patent Laid-Open Publication No. 41079/1985 (referred to as Prior Art 2 hereinafter) teaches an image forming apparatus having a collected toner storing section above the developing section of the developing means in addition to a fresh toner storing section. The supplement of the collected toner from the collected toner storing section and the supplement of the fresh toner from the fresh toner storing section are adequately controlled.

Another problem with the collected toner is that it deteriorates due to the repetitive image forming process, i.e., it becomes difficult to charge and contains an inversely charged toner. Hence, when the collected toner is supplemented to the developing section in a great amount at a time, it is apt to contaminate the background of an image, fly out of the developing means. To eliminate this problem, Japanese Patent Laid-Open Publication No. 57365/1985 (referred to as Prior Art 3 hereinafter) proposes an image forming apparatus including an optical sensor responsive to the density of an image having been transferred. When the image density is lowered as determined by the sensor, the collected toner is continuously supplemented and the fresh toner is supplemented. When the image density is not lowered and the transfer ratio of a toner image to a sheet is lowered, a predetermined amount of fresh toner is supplemented or the recycling operation is interrupted. This prevents the collected toner from being supplemented alone when the image density is not lowered and, therefore, insures desirable image quality and satisfactory cleaning.

To transport the toner removed from the image carrier by the cleaning means to the developing means, use may be made of a screw conveyor, as disclosed in Japanese Patent Utility Model Laid-Open Publication No. 155044/1977 (referred to as Prior Art 4 hereinafter). Alternatively, the transport may be implemented by a screw for conveying the collected toner, an elastic rotatable plate disposed in a compartment, and a belt conveyor onto which the rotatable plate throws the incoming toner, as taught in Japanese Utility Model Laid-Open Publication No. 130962/1981 (referred to as Prior Art 5 hereinafter). The rotatable plate, therefore, serves to change the direction of transport.

Prior Art 1 is not satisfactory since it does not control the time for returning the collected toner to the developing means or the time for supplementing the fresh toner to the developing means at all. Specifically, Prior Art 1 simply transports the toner sequentially to the developing means at a constant speed when the toner is collected. Since the collected toner is lower in charge than the fresh toner, it is apt to deposit on the background of the image carrier and, when the mixture ratio thereof to the fresh toner is great, it easily contaminates the background of an image on a sheet. When the mixture ratio is not constant, the contamination of the background becomes conspicuous. Particularly, when the apparatus approaches a toner end condition, the fresh toner and the collected toner are easily brought out of balance, aggravating the contamination of the background.

Prior Art 2 supplements the fresh toner and collected toner from the respective storing sections without relating their supplementary amounts to each other. It is likely, therefore, that the supplementary amount of the collected toner exceeds a certain limit to contaminate the background or fly out of the developing means, degrading the image quality and inviting defective cleaning.

Further, Prior Art 3 executes toner supply control only after the image transfer ratio has been lowered and, therefore, cannot immediately cope with the background contamination and other undesirable occurrences. Moreover, Prior Art 3 determines the image transfer ratio in terms of the amount of toner left on the image carrier after image transfer and sensed by an optical sensor. This is undesirable from the stability standpoint since the amount of residual toner on the image carrier greatly depends on the kind of an image (character, solid image, and density). In addition, the problems stemming from the collected toner become more prominent when the image density is lowered than when it is not lowered.

The contamination of the background, scattering of the toner, and other phenomena each occur in a particular manner depending on the change in the potential of the image carrier and the deterioration of the carrier which are ascribable to aging, varying ambient conditions, etc. The conventional image forming apparatuses cannot satisfactorily cope with aging, changes in environment, etc.

Prior Art 4 and Prior Art 5 both return the collected toner to the developing means by mechanical transporting means and, therefore, have various problems, as follows. The mechanical transporting means is apt to lower the transport efficiency. Since such transporting means conveys the toner by applying a load on the toner, it is likely to pulverize the toner or to cause the particles of the toner to stick together. The pulverized toner and sticked toner broaden the particle size distribution of the toner to contaminate the background, fly out of the developing means, or cause part of a solid image to be left blank in spots. In addition, the mechanical transport is likely to damage the apparatus due to the fast adhesion of the toner and the stop-up by the toner.

SUMMARY OF THE INVENTION

It is, therefore, an object of the present invention to provide a highly reliable image forming apparatus capable of producing attractive images without background contamination while using the collected toner effectively and capable of eliminating the scattering of toner, etc.

In accordance with the present invention, an image forming apparatus comprises a developing unit comprising a toner storing section and a developing section for developing a latent image formed on an image carrier by depositing a toner on the latent image, toner supplementing means for supplementing the toner from the toner storing section to the developing section, a cleaning unit for collecting the toner remaining on the image carrier, a toner conveyor for conveying the toner collected by the cleaning unit to the developing unit, and a control section for controlling drive sections associated with the toner supplementing means and toner conveyor such that an amount of the toner fed from the toner storing section to the developing section and an amount of the toner conveyed to the developing unit by the toner conveyor have a ratio lying in a predetermined range.

Also, in accordance with the present invention, an image forming apparatus comprises a developing unit comprising a toner storing section and a developing section for developing a latent image formed on an image carrier by depositing a toner on the latent image, toner supplementing means for supplementing the toner from the toner storing section to the developing section, a cleaning unit for collecting the toner remaining on the image carrier, a toner conveyor for conveying the toner collected by the cleaning unit to the developing unit, a blocking and unblocking member associated with an opening of the toner conveyor communicating to the developing unit for selectively opening or closing the opening, and a control section for controlling drive sections associated with the toner supplementing means and opening and closing member such that that an amount of the toner fed from the toner storing section to the developing section and an amount of the toner conveyed to the developing unit by the toner conveying means have a ratio lying in a predetermined range.

Also, in accordance with the present invention, an image forming apparatus comprises a developing unit comprising a toner storing section and a developing section for developing a latent image formed on an image carrier by depositing a toner on the latent image to thereby produce a toner image, fresh toner supplementing means for supplementing a fresh toner from the toner storing section to the developing section, a cleaning unit for collecting a toner remaining on the image carrier after the toner image has been transferred to a transfer medium, a collected toner storing section provided in the developing unit independently of the toner storing section, toner conveying means for conveying the toner collected by the cleaning unit to the collected toner storing section, collected toner supplementing means for supplementing the toner from the collected toner storing section to the developing unit, and a control section for controlling drive sections associated with the fresh toner supplementing means and collected toner supplementing means such that a ratio of the toner collected to the entire toner existing in the developing section is lower than a predetermined ratio.

Further, in accordance with the present invention, an image forming apparatus comprises a developing unit for developing a latent image formed on an image carrier by depositing a toner on the latent image to thereby produce a corresponding toner image, a cleaning unit for collecting the toner remaining on the image carrier after the toner image has been transferred to a transfer medium, toner conveying means for conveying the toner collected by the cleaning unit to the developing unit, a developing ability sensor for determining a developing ability of the developing unit, toner supplementing means capable of supplementing a fresh toner and the toner collected to a developing section included in the developing unit, and condition setting means responsive to an output of the developing ability sensor for setting a condition under which the fresh toner and the toner collected should be supplemented such that contamination of a background, scattering of the toner and other undesirable occurrences are eliminated and a predetermined developing ability is maintained.

Furthermore, in accordance with the present invention, an image forming apparatus comprises a developing unit comprising a developing section for developing a latent image formed on an image carrier by depositing a toner on the latent image to thereby produce a corresponding toner image, a cleaning unit for collecting the toner remaining on the image carrier after the toner image has been transferred to a transfer medium, a toner conveyor for conveying the toner collected by the cleaning unit to the developing unit, toner supplementing means capable of supplementing a fresh toner and the toner collected by the cleaning unit to the developing section of the developing unit, and a control section for controlling a first and a second supplement member which feed respectively the fresh toner and the toner collected from the toner supplementing means to the developing section, such that the second supplement member feeds a smaller amount of toner than the first supplement member.

Moreover, in accordance with the present invention, an image forming apparatus comprises a developing unit having a developing section for developing a latent image formed on an image carrier by depositing a toner on the latent image to thereby produce a corresponding toner image, a cleaning unit for collecting the toner remaining on the image carrier after the toner image has been transferred to a transfer medium, toner conveying means for conveying the toner collected by the cleaning unit to the developing unit, toner supplementing means capable of supplementing a fresh toner and the toner collected to the developing section of the developing unit, and condition setting means for setting a particular supplement condition for the fresh toner and the toner collected such that the fresh toner and toner collected are sequentially supplemented in this order.

In addition, in accordance with the present invention, an image forming apparatus comprises a developing unit for developing a latent image formed on an image carrier by depositing a toner on the latent image to thereby produce a corresponding toner image, a cleaning unit for collecting the toner remaining on the image carrier after the toner image has been transferred to a transfer medium, and toner conveying means for conveying the toner collected by the cleaning unit to the developing unit. The toner conveying means comprises a temporary toner storing section intervening between the cleaning unit and the developing unit, a first toner conveying member for conveying the toner from the cleaning unit to the temporary toner storing section by a stream of air, a second toner conveying member for conveying the toner from the temporary toner storing section to the developing unit by a stream of air, and a toner transport control section for causing each of the first and second toner conveying members to operate at a particular timing.

BRIEF DESCRIPTION OF THE DRAWINGS

The above and other objects, features and advantages of the present invention will become more apparent from the following detailed description taken with the accompanying drawings in which:

FIG. 2B is a table associated with FIG. 2A, showing a relation between the output level of a P sensor and whether or not to supplement a toner;

DESCRIPTION OF THE PREFERRED EMBODIMENTS

Figure 17:
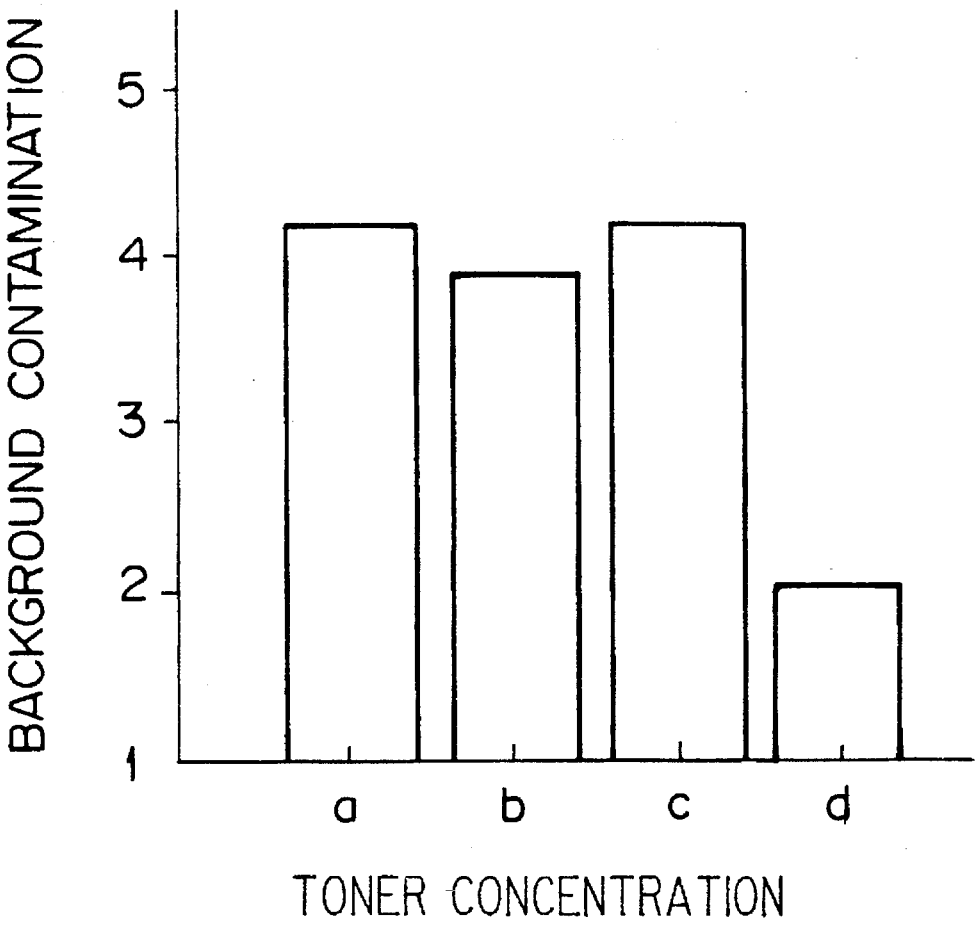
FIG. 17 is a graph indicative of a relation between the number of copies produced and the background contamination.

FIG. 17 shows respectively a relation between the number of copies produced and the toner concentration in a developing section, and a relation between the number of copies and the background contamination. In FIG. 17, a, b, c and d on the abscissa correspond respectively to image forming apparatuses conditioned to have particular developing abilities by changing the toner concentration to 3 wt %, about 4 wt %, 3 wt %, and 2 wt %, as shown in FIG. 17. In FIG. 17, the ordinate shows background contamination ranks determined by supplementing the same amount of collected toner to the developing sections of the developing means incorporated in the respective image forming apparatuses. The greater the rank number, the less the background contamination is. Assume that the target toner concentration is 3 wt %. As FIG. 17 indicates, when the same amount of collected toner is supplemented to the developing sections of the developing means, the background contamination is not conspicuous when the toner concentration is high, but it is conspicuous when the toner concentration is low. This presumably stems from the following occurrence. The toner collected to be reused has been deteriorated due to the repetitive image forming process and is difficult to charge, as stated earlier. Therefore, even when the collected toner is fed to the developing section where the ratio Q/M (charge deposition per unit mass) of the toner is increased due to the decrease in toner concentration to such a degree that the toner is adhered to the carrier by an intense electrostatic force, the collected toner cannot be sufficiently charged by friction. Further, in such a condition, an inversely charged toner is apt to occur in the developing section.

Preferred embodiments of the image forming apparatus in accordance with the present invention will be described which are implemented as electrophotographic copiers by way of example.

[1st Embodiment]

Figure 1:
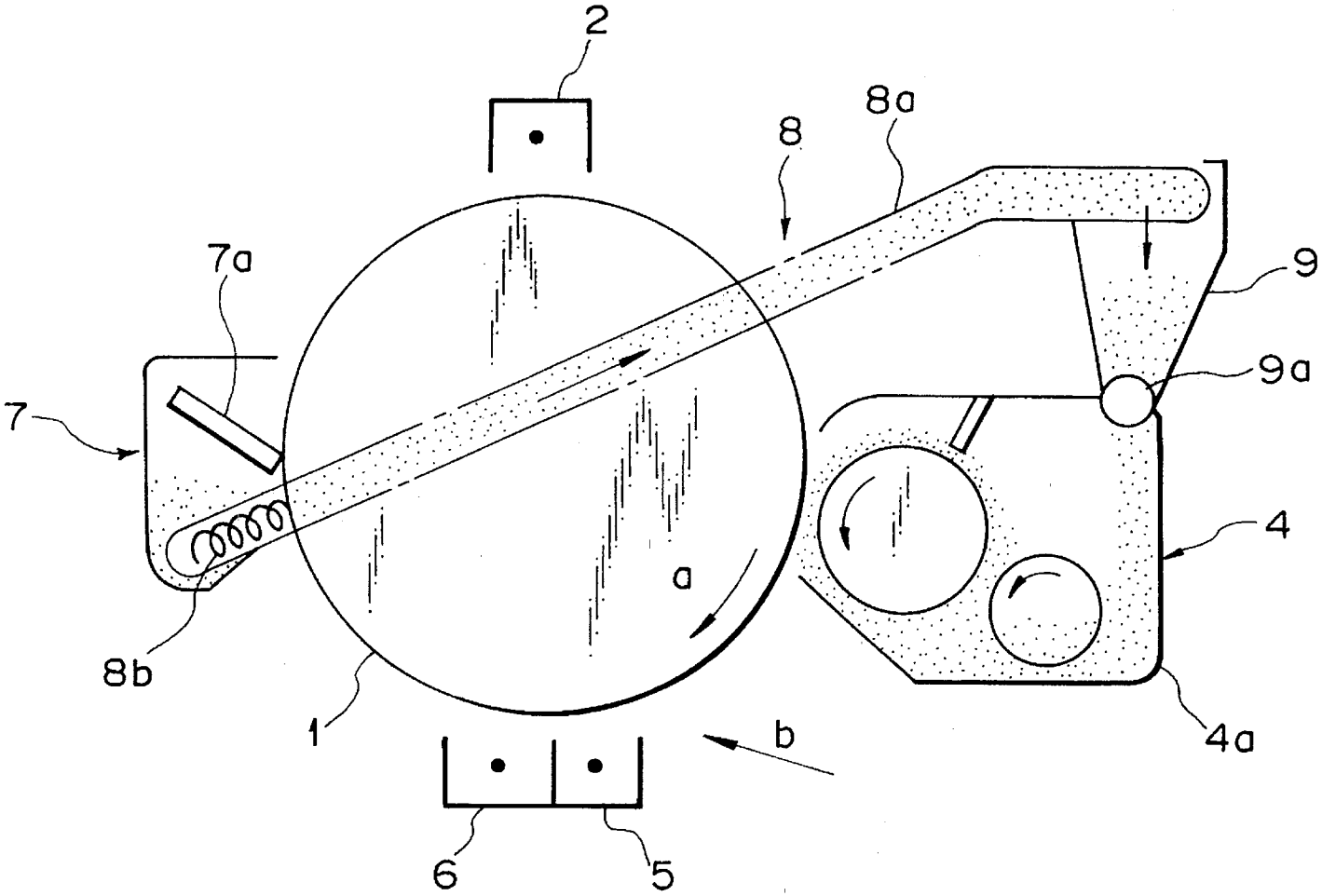
FIG. 1 shows a copier embodying the present invention.

Referring to FIG. 1, a copier embodying the present invention includes a photoconductive drum 1 which plays the role of an image carrier and rotates in a direction indicated by an arrow a. A main charger 2 uniformly charges the surface of the drum 1 by corona discharge. Optical image data, e.g., an imagewise reflection from a document is incident on the charged surface of the drum 1 to electrostatically form a latent image thereon. A developing unit 4 deposits a toner on the latent image to convert it to a toner image. While a sheet is fed in a direction indicated by an arrow b, a transfer charger 5 transfers the toner image from the drum 1 to the sheet. After the image transfer, a separation charger 6 separates the sheet from the drum 1. Then, the sheet is transported to a fixing unit, not shown, to have the toner image fixed thereon. A cleaning unit 7 is located downstream of the separation charger 6 with respect to the direction of rotation of the drum 1. The cleaning unit 7 removes the toner remaining on the drum 1 after the image transfer.

The cleaning unit 7 has a cleaning blade 7*a* for scraping off the remaining toner from the drum 1. A toner conveyor 8 is connected to the cleaning unit 7 for conveying the toner collected by the blade 7*a* to the developing unit 4. The toner conveyor 8 has a tube 8*a* and a spiral rotatable member 8*b* accommodated in the tube 8*a*. The spiral member 8*b* is rotated to convey the collected toner to the developing unit 4. In the illustrative embodiment, a toner hopper 9 is provided on the top of the developing unit 4 and receives the collected toner coming out of the tube 8*a*.

The developing unit 4 has a casing 4*a* to which the toner is fed from the toner hopper 9. To feed the toner to the casing 4*a* in a particular amount and at a particular timing, it is a common practice to form a reference density pattern on the drum 1 outside of an image forming area and to determine the amount of toner deposited on the reference pattern by an optical sensor (referred to as a P sensor hereinafter), not shown. A control device, not shown, executes required control in response to the output of the P sensor.

Figure 2A:
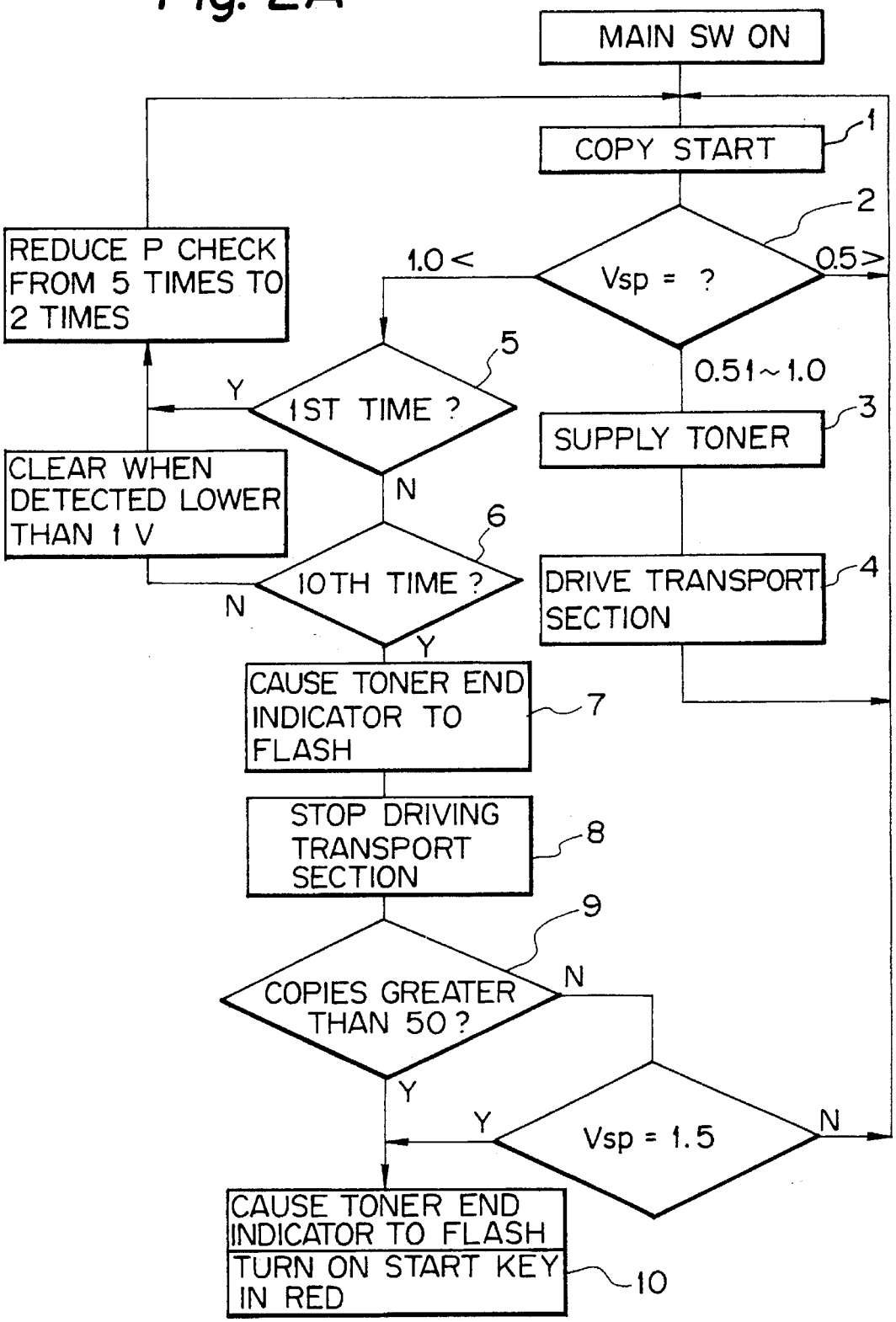
FIG. 2A is a flowchart demonstrating a specific toner supplement control procedure particular to the embodiment.

FIG. 2A is a flowchart demonstrating a specific toner supplement control procedure to be executed by the embodiment. FIG. 2B is a table indicative of a relation between the output level of the P sensor and the supplement/non-supplement and supplement ratio of the toner. As shown, the P sensor output $V_{SG}$ associated with the background of the drum 1 where no toner is deposited is set at 4.0 V. Whether or not to supply the toner from the hopper 9 to the casing 4*a* and the toner end level are determined on the basis of a P sensor output $V_{SP}$ appearing when the toner is deposited. A toner supplement roller 9*a* plays the role of toner supplementing means. The toner supplement level, i.e., the duration of the drive of the roller 9*a*, is adjusted on the basis of the ratio of $V_{SP}$ to $V_{SG}$. In this embodiment, the toner is supplemented from the hopper 9 to the casing 4*a* when the ratio $V_{SP}/V_{SG}$ exceeds 12.6%, as shown in FIG. 2B. In FIG. 2B, the P sensor output $V_{SP}$ associated with toner deposition is divided into five consecutive levels each effecting toner supplement in a particular ratio.

The supplement is implemented by the drive of the toner supplement roller 9*a* and the movement of the spiral member 8*b* for feeding the collected toner. The embodiment is characterized in that the supplement of the toner from the toner hopper 9 to the casing 4*a*, i.e., the drive of the toner supplement roller 9*a* and the feed of the collected toner to the hopper 9, are effected substantially at the same time. When the P sensor output $V_{SP}$ lies in a range of 0.51–1.0 V (step S2, FIG. 2A), the toner is supplemented from the hopper 9 to the casing 4*a* and, at the same time, the toner conveyor 8 is driven to feed the collected toner to the hopper 9 (steps 3 and 4, FIG. 2A). When the toner end supplement level is reached, the toner conveyor 8 is deactivated (steps 7, 8, FIG. 2A).

As stated above, the embodiment supplies the toner from the hopper 9 to the casing 4*a* and feeds the collected toner to the hopper 9 by the toner conveyor 8 substantially at the same time. As a result, the mixture ratio of a fresh toner and the collected toner is held in a predetermined range, eliminating defective images, e.g., images with contaminated background. Since a single toner conveyor suffices, the number of constituent parts and, therefore, the cost is reduced.

[2nd Embodiment]

Figure 3:
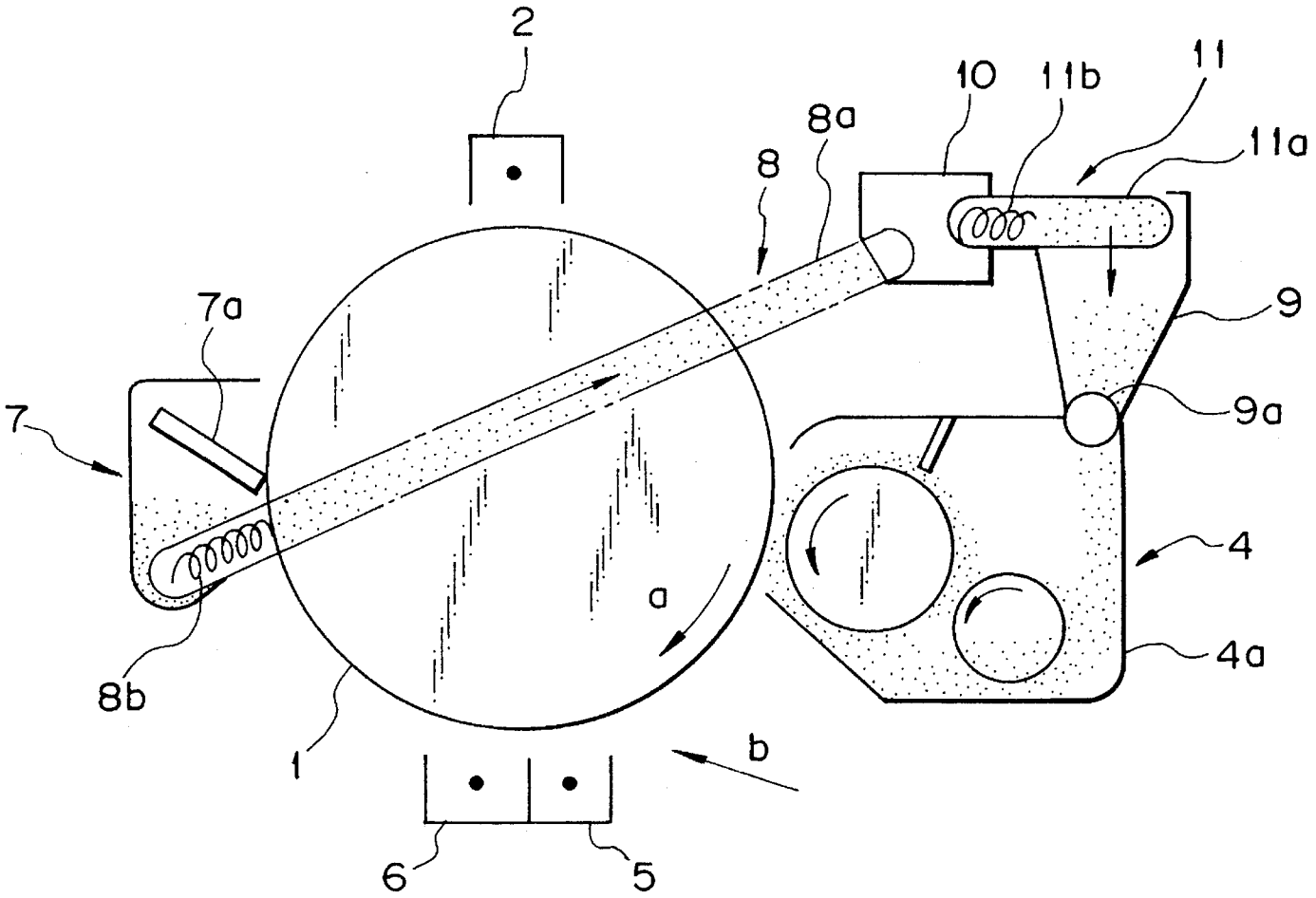
FIGS. 3 and 4 each shows an alternative embodiment of the present invention.

FIG. 3 shows an alternative embodiment of the present invention. As shown, the toner conveyor 8 is connected to the toner hopper 9 by way of an intermediate receptacle, or temporary storing means, 10 and a second toner conveyor, or second toner conveying means, 11. The intermediate receptacle 10 has a predetermined capacity for accommodating the collected toner. The second toner conveyor 11, like the first toner conveyor 8, has a tube 11*a* and a spiral rotatable member 11*b* received in the tube 11*a*. The toner conveyors 8 and 11 are each driven by a motor included in a drive section, not shown.

As stated above, this embodiment has two or more toner conveying means, connects the conveying means by the intermediate receptacle 10, and drives the spiral member 11*b* of the second conveyor 11 and the toner supplement roller 9*a* substantially at the same time. In this configuration, even when the amount of toner collected in the cleaning unit 7 and the amount of collected toner to be fed by the conveyor member are brought out of balance, the collected toner is fed to the developing unit 4 in a constant amount without fail. As a result, the mixture ratio of the fresh toner and the collected toner is confined in a predetermined range, eliminating defective images, e.g., images with contaminated background. In the system which directly connects the toner conveyor to the hopper 9, it is likely that when the amount of toner collected in the cleaning unit 7 increases, the amount of toner to be transported becomes excessively small, i.e., the collected toner accumulates in the cleaning unit 7 to increase the load. By contrast, in the embodiment, the conveyor 8 terminates at the intermediate receptacle 10 capable of accommodating a predetermined amount of toner. This prevents the collected toner from accumulating in a great amount only in the cleaning unit 7. Furthermore, since the first conveyor 8 does not have to transport the collected toner in synchronism with the toner supplement roller 9*a*, the load on the cleaning unit 7 ascribable to the accumulation of toner is prevented from increasing.

In the illustrative embodiment, when the distance between the cleaning unit 7 and the developing unit 4 is long, three or more toner conveyors may be provided. While the embodiment has the intermediate receptacle 10 in the vicinity of the hopper 9, the receptacle 10 may be disposed in the vicinity of the cleaning unit 7 or in the vicinity of both of the cleaning unit 7 and hopper 9. It is not necessary that the first toner conveyor 8 be driven at the same time as the toner is fed from the hopper 9 to the casing 4*a*. Specifically, when an excessive amount of collected toner exists in the cleaning unit 7, the conveyor 8 can transfer it to the intermediate receptacle 10 with no regard to the drive of the toner supplement roller 9*a*. The gist is that the supplement of toner from the second toner conveyor 11 to the hopper 9 is synchronous to the drive of the toner supplement roller 9*a*.

[3rd Embodiment]

Figure 4:
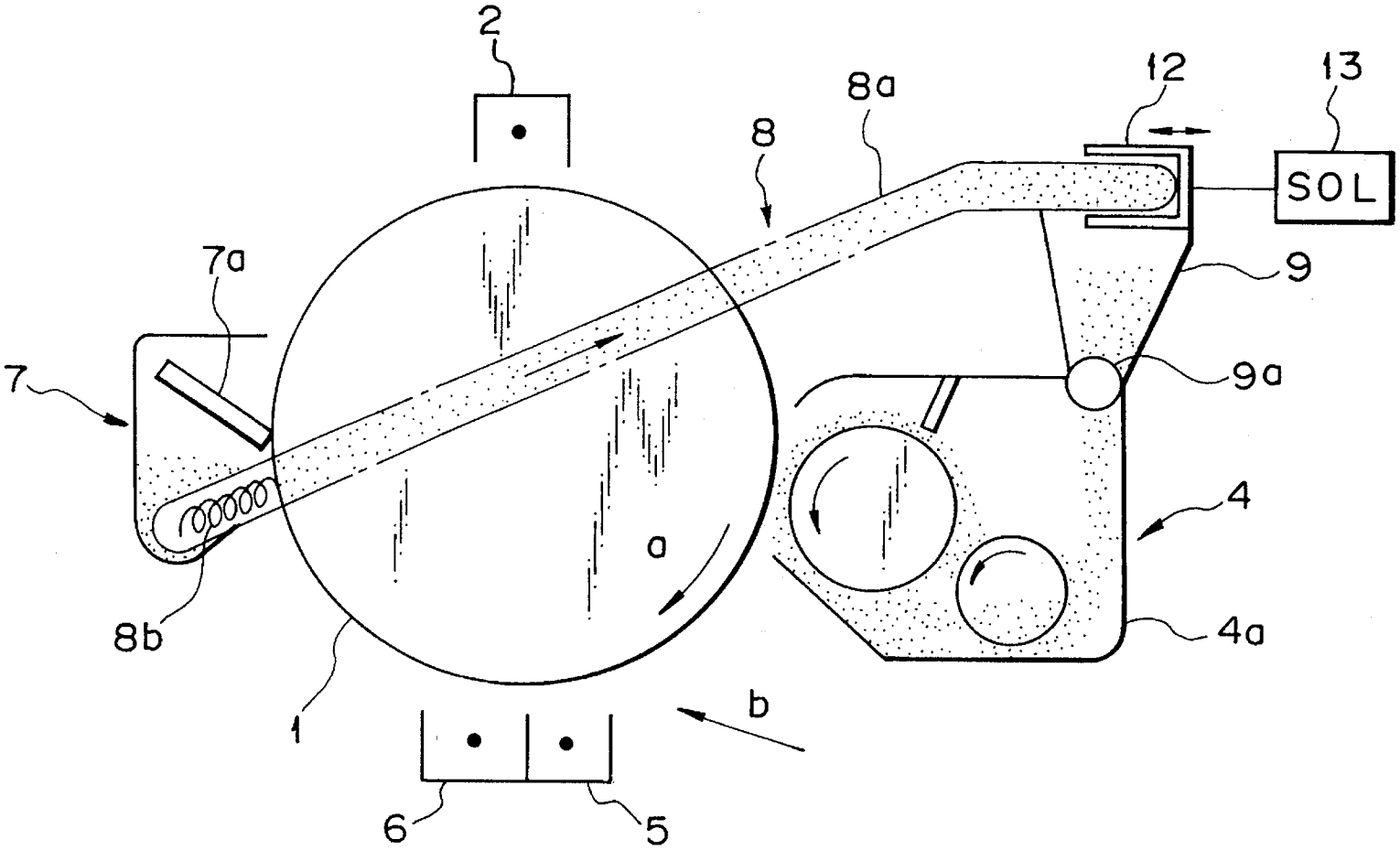

FIG. 4 shows a third embodiment which is similar to the first embodiment in that the cleaning unit 7 is directly connected to the toner hopper 9 by the toner conveyor 8. The difference is that a shutter 12 intervenes between the open end of the toner conveyor 8 and the inlet of the hopper 9 and is opened and closed by a solenoid 13. In this configuration, the amount of toner supplemented to the hopper 9 is adjusted by the shutter 12. When two toner conveyors are used as shown in FIG. 3, the shutter 12 may be located at the open end of the second toner conveyor 11. When the conveyor 8 transports the toner over a substantial distance as in FIG. 1 or 3, it is likely that the transport efficiency is lowered and, therefore, the supplement of the collected toner becomes irregular even when the toner supplement roller 9*a* is synchronized to the conveyor 8 or 11. In light of this, the embodiment operates the shutter 12 substantially at the same time as the supplement of the collected toner to the casing 4*a* by the toner supplement roller 9*a*.

As stated above, the third embodiment locates the shutter 12 at the open end of the toner conveyor 8 adjacent to the hopper 9 and opens and closes the shutter 12 substantially at the same time as it causes the toner supplement roller 9*a* to supplement the collected toner to the casing 4*a*. Hence, even when the path for conveying the collected toner is long, efficient toner transport and, therefore, stable toner supplement is insured. As a result, the mixture ratio of the fresh toner and the collected toner is held in a predetermined range at all times, eliminating defective images, e.g., images with contaminated background.

As shown in FIG. 2B, the embodiments described so far do not feed the collected toner to the developing unit 4 when the toner end supplement level is reached. This prevents the mixture ratio of the fresh toner and the collected toner from being noticeably disturbed to effect the image quality.

[4th Embodiment]

Figure 5:
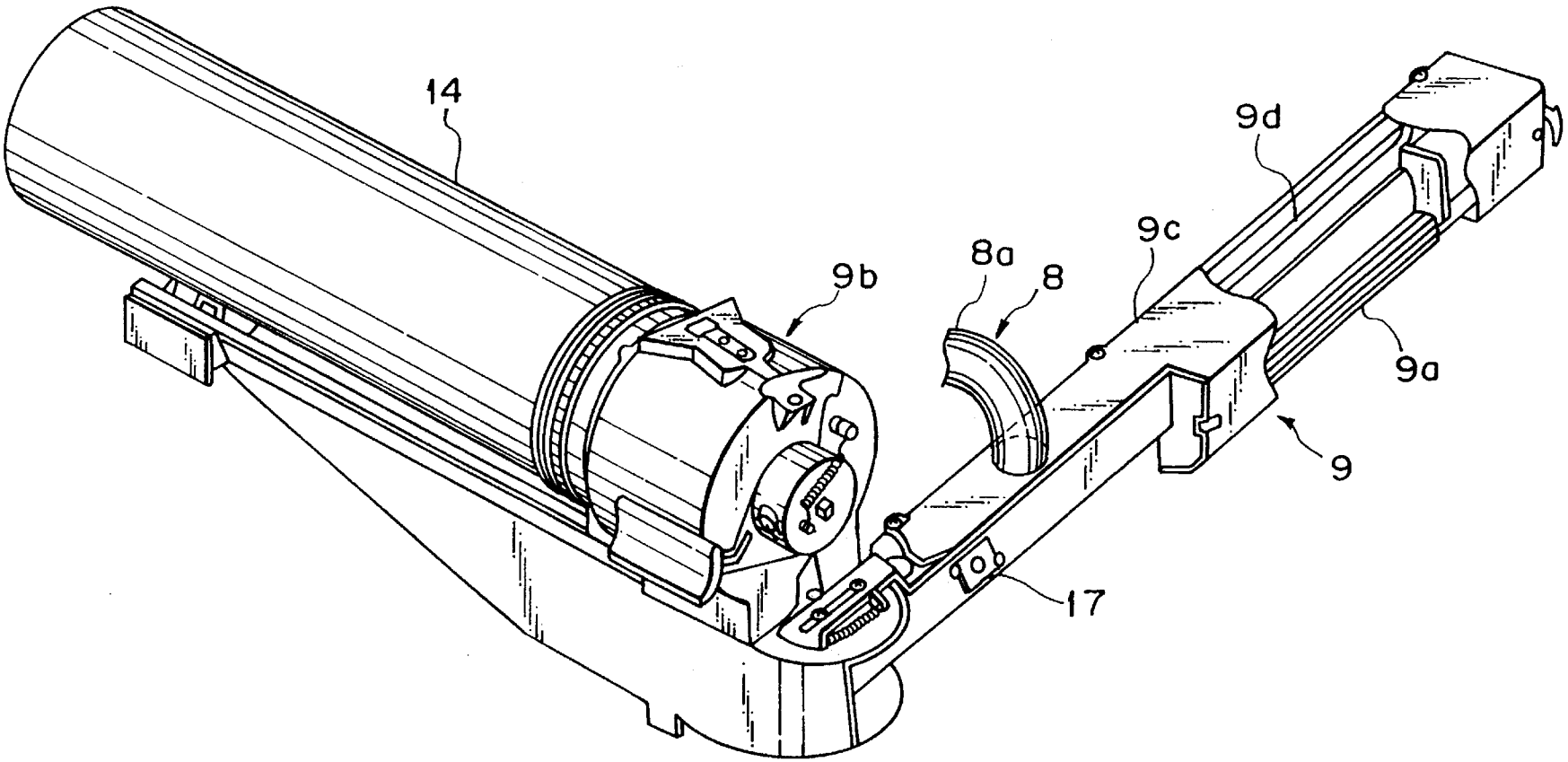
FIGS. 5–8 show another alternative embodiment of the present invention.
Figure 6:
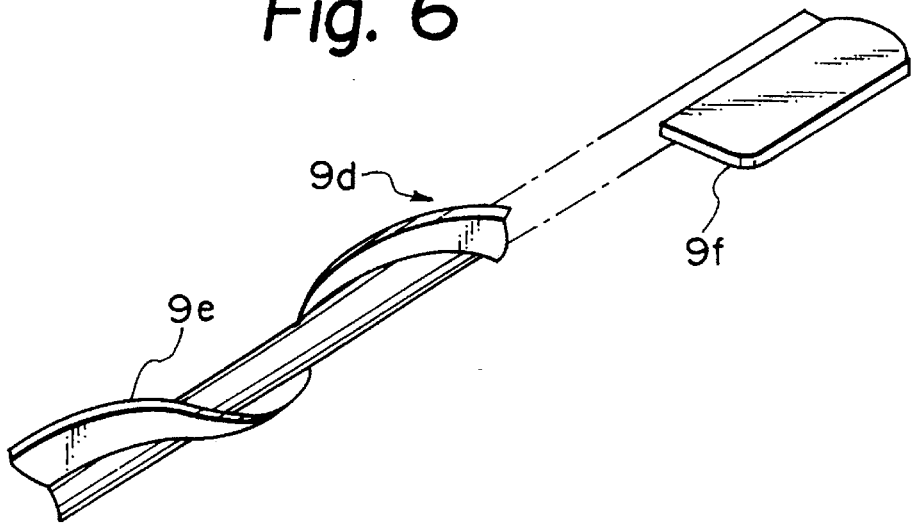
Figure 7:
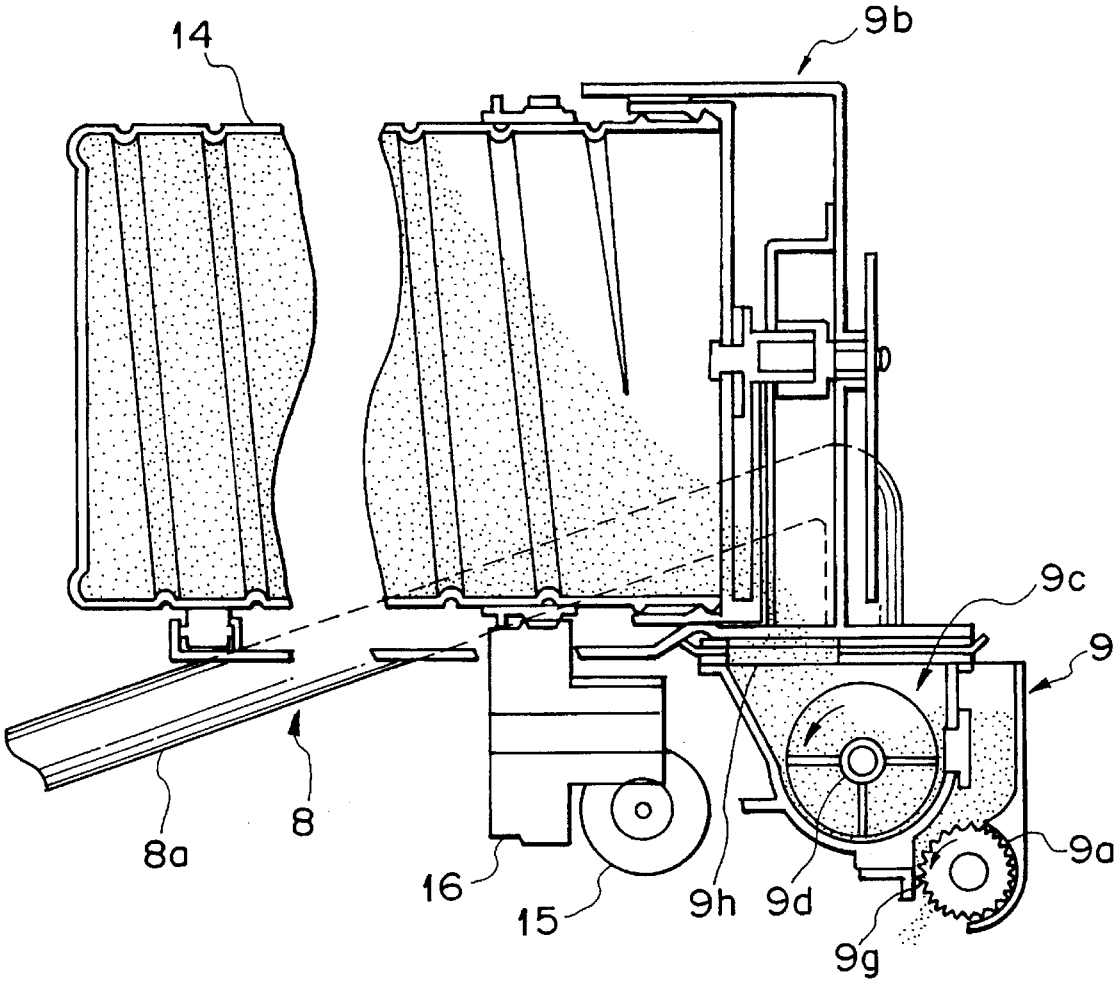

Referring to FIGS. 5, 6 and 7, a fourth embodiment of the present invention includes a toner container mounting portion 9*b* forming part of the toner hopper 9. A toner container or cartridge 14 filled with a fresh toner is removably set at the mounting portion 9*b*. The open end of the tube 8*a* of the toner conveyor 8 is communicated to a transport path 9*c* formed in the hopper 9. An agitator 9*d* is disposed in the transport path 9*c*. As shown in FIG. 6, the agitator 9*d* is made up of a shaft (no numeral), a spiral member 9*e* affixed to the shaft and adjoining the mounting portion 9*b*, and a flat member 9*f* affixed to the shaft and adjoining the toner supplement roller 9*a*. The collected toner from the conveyor 8 and the fresh toner from the toner cartridge 14 are agitated and transported toward the toner supplement roller 9*a* by the spiral member 9*e* of the agitator 9*d* along the transport path 9*c* and then fed to the roller 9*a* by the flat member 9*f* being rotated.

The toner supplement roller 9*a* is rotated in response to the output of the P sensor, not shown, adapted for toner supplement control. As a result, the toner is fed to the casing 4*a* of the developing unit 4 via a slit 9*g*. At this instant, the toner cartridge 14 is rotated about the axis thereof by gears 15 and 16. As a result, the fresh toner filled in the cartridge 14 is sequentially fed toward the opening of the container 14 (rightward as viewed in FIG. 7) and is then transferred to the transport path 9*c* of the hopper 9 via a fresh toner inlet 9*h*. The agitator 9*d* is operatively associated with the toner supplement roller 9*a*. Therefore, as the toner supplement level is reached, the toner supplement roller 9*a*, agitator 9*d* and toner container 14 are rotated at the same time.

Generally, an image having a substantial area is copied, the amount of toner consumption and, therefore, the amount of toner supplement increases, resulting in an increase in the amount of toner collected by the cleaning unit 7. The collected toner is transported to and reused by the developing unit 8. However, the problem is that since the toner conveyor 8 has a substantial length, the time when the collected toner begins to be fed from the cleaning unit 7 and the time when it is actually fed to the agitator 9*d* in the transport path 9*c* are not coincident. Specifically, assume that the feed of the collected toner to the agitator 9*d* in the transport path 9*c* and the feed of the toner from the hopper 9 to the casing 4*a* are not synchronous, e.g., the toner conveyor 8 is continuously driven with no regard to the drive of the toner supplement roller 9*a*. Then, as a great amount of toner is fed from the hopper 9 to the casing 4*a*, the collected toner corresponding in amount to the toner fed from the hopper 9 to the casing 4*a* is fed to the agitator 9*d* after the feed from the hopper 9 to the casing 4*a* due to the above-mentioned time lag. Here, the feed of a great amount of toner from the hopper 9 to the casing 4*a* means the consumption of a corresponding amount of toner on the drum 1 and, therefore, the increase in the amount of collected toner. As a result, the amount of collected toner increases in the hopper 9 and is brought out of balance with the fresh toner. To eliminate such an occurrence, the embodiment synchronizes the drive of the toner supplement roller 9*a*, agitator 9*d* and toner container 14 and the drive of the toner conveyor 8. This confines the mixture ratio of the fresh toner and the collected toner in a predetermined range and thereby prevents the image quality from being degraded.

In this embodiment, a piezoelectric sensor 17 is located upstream of the position where the transport path 9*c* is communicated to the toner conveyor 8 so as to detect the end of the fresh toner. When the toner cartridge 14 runs out of the fresh toner, the resulting decrease in the amount of fresh toner being transported in the path 9*c* is sensed by the piezoelectric sensor 17. Then, the toner conveyor 8 is caused to stop transporting the collected toner. Such a procedure maintains the mixture ratio of the fresh toner and the collected toner in a predetermined range even when the fresh toner ends, insuring attractive images.

In the embodiments described so far, the drive of the toner conveyors 8 and 11 and that of the toner supplement roller 9*a* are driven under the control of a microcomputer or similar controller, not shown.

[5th Embodiment]

Figure 8:
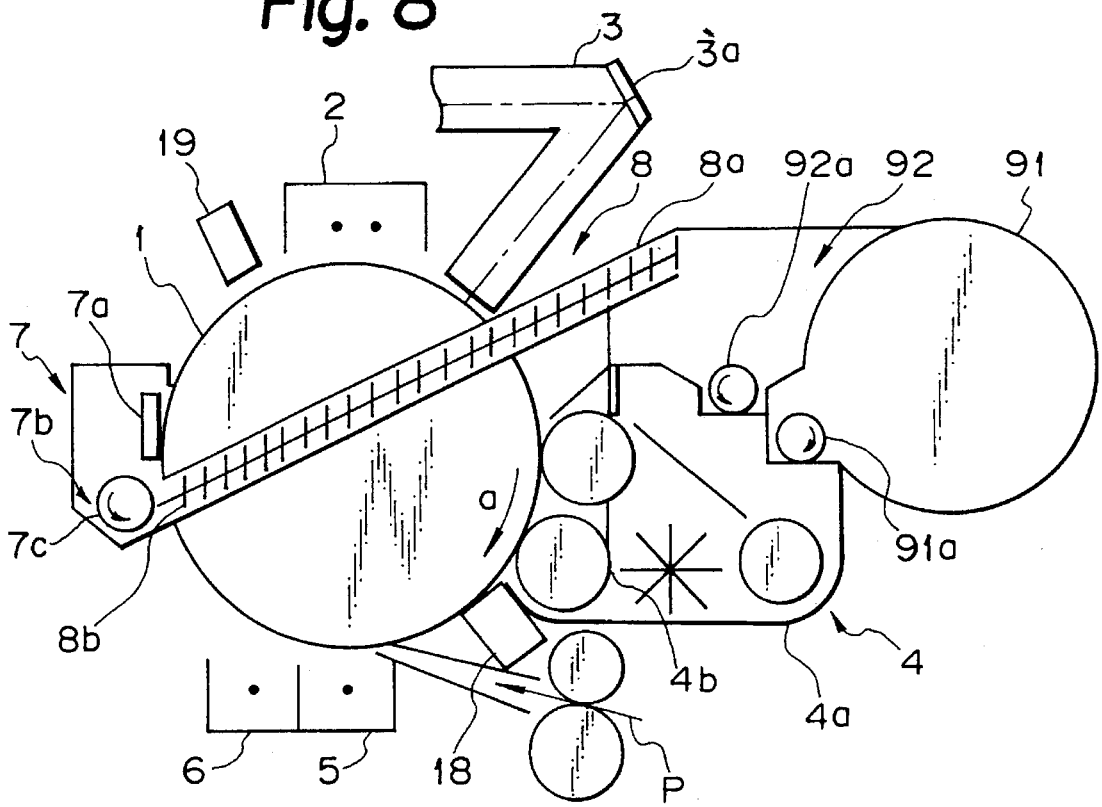

FIG. 8 shows a fifth embodiment of the present invention. To begin with, the general construction of the copier will be described. The copier uses a reversal development system, i.e., a photoconductive drum or image carrier 1 whose photoconductive layer is implemented by, for example, a negatively chargeable organic photoconductor (OPC) and a two component developer containing a negatively chargeable toner. While the drum 1 is rotated in the direction a, the main charger 2 uniformly charges the surface of the drum 1. Optics, not shown, include a mirror 3*a* and scan the charged surface of the drum 1 in the axial direction of the drum 1, i.e., the main scanning direction, with a laser beam 3 associated with image data. Scanning in the subscanning direction is implemented by the rotation of the drum 1. As a result, a latent image associated with the image data is electrostatically formed on the drum 1. The developing unit 4 develops the latent image to produce a corresponding toner image. The surface potential of the drum 1 in the event of development is selected to be about −800 V in the background (dark area potential $V_P$) and about −100 V in the image area (light area potential $V_L$). In the image area, the negatively charged toner deposits due to the difference between the surface potential and a bias voltage $V_B$ of about −600 V for development, thereby developing the latent image. The toner image is transferred to a sheet P by the transfer charger 5. Then, the sheet P is separated from the drum 1 by the separation charger 6. Finally, the toner image on the sheet P is fixed by a fixing unit, not shown. The toner remaining on the drum 1 after the image transfer is removed by the cleaning unit 7, and then the charge also remaining on the drum 1 is dissipated by the discharge lamp 19. As a result, the surface of the drum 1 is prepared for the next image forming cycle.

To maintain the toner concentration of the developer in the casing 4*a* constant, a latent image representative of a reference density pattern is formed on the drum 1 outside of the image forming area and is then developed by the developing unit 4. To measure the optical density of the resulting toner image, an optical sensor or P sensor 18 responsive to a reflection is located to face the drum 1 and adjoins the drum 1 at a position downstream of the developing unit 4. The output of the P sensor 18 is indicative of the toner concentration of the developer in the casing 4*a*.

The reuse of the collected toner will be described hereinafter. In the above-described image transfer process, part of the toner image formed on the drum 1 remains on the drum 1 without being transferred to a sheet. This part of the toner is scraped off by the elastic cleaning blade 7*a* disposed in the cleaning unit 7 and rubbing against the drum 1. The toner so removed from the drum 1 drops into a collecting chamber 7*b* along a guide, not shown. A toner transport roller 7*c* is provided on the bottom of the chamber 7*b* and implemented as a screw-shaped rotary body journalled to the opposite side walls of the casing of the cleaning unit 7. Driven by a mechanism, not shown, the roller 7*c* moves the collected toner in a direction perpendicular to the sheet surface of FIG. 8. As a result, the collected toner is transferred to the toner conveyor 8 via an opening formed through the chamber 7*b*. A toner hopper 92 is provided on the top of the developing device 4 for receiving the collected toner. A toner hopper 91 accommodates a fresh toner and is independent of the toner hopper 92. The toner conveyor 8 has the tube 8*a* communicating the collecting chamber 7*b* of the cleaning unit 7 to the toner hopper 92, and the spiral member 8*b* rotatably disposed in the tube 8*a*. The collected toner is transported to the toner hopper 92 by the toner conveyor 8 and is then fed to the casing 4*a* in an adequate amount by a collected toner supplement roller 92*a* which is located on the bottom of the hopper 92. The roller 92*a* plays the role of collected toner supplementing means. On the other hand, a fresh toner stored in the toner hopper 91 is fed to the casing 4*a* in an adequate amount by a fresh toner supplement roller, or fresh toner supplementing means, 91*a*.

Regarding the mixture of the collected toner and the fresh toner, difficulty has been encountered in maintaining the total toner concentration constant and insuring the stable charge deposition on the toner. Another problem heretofore left unsolved is that when the amount of collected toner is fed in an amount exceeding a certain limit, the background is contaminated and the toner is scattered around. This not only degrades the image quality but also invites defective image transfer and detective cleaning. In light of this, the fifth embodiment controls the collected toner supplement roller 92*a* and fresh toner supplement roller 91*a* such that the ratio of the collected toner to the entire toner in the casing 4*a* remains lower than a predetermined one. For example, assume that the toner concentration of the developer in the casing 4*a* is lower than a reference value as indicated by the output of the P sensor 18. Then, solenoids associated with the rollers 92*a* and 91*a* are energized to supplement the associated toners. At this instant, the durations of rotation of the rollers 92*a* and 91*a* are controlled such that the fresh toner and the collected toner are fed in a ratio of 8:2. This is effected by a microcomputer or similar controller, not shown.

Figure 9:
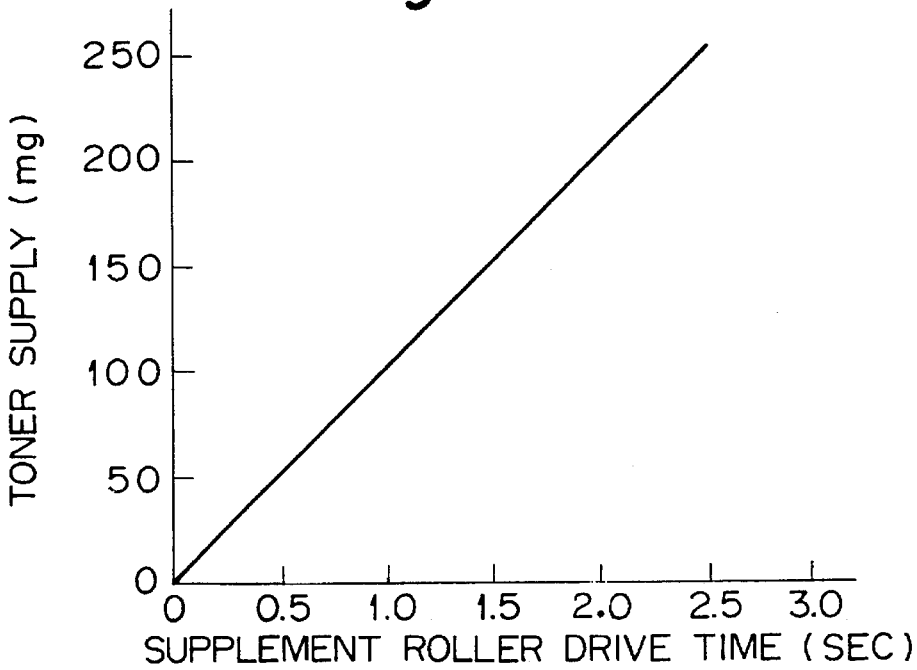
FIG. 9 is a graph indicative of a relation between the duration of rotation of a toner supplement roller included in the embodiment of FIG. 8 and the amount of toner supplement.

FIG. 9 shows a relation between the duration of rotation of the toner supply roller and the amount of toner supplemented. As shown, assuming that the collected toner and fresh toner have to be supplemented in an amount of 50 mg in combination, the collected toner supplement roller 92*a* and the fresh toner supplement roller 91*a* are rotated for 0.1 second and 0.4 second, respectively. Then, 40 mg of fresh toner and 10 mg of collected toner are fed to the casing 4*a* together. In the casing, the fresh and collected toners are mixed and agitated and then driven toward the developing roller 4*b*.

As stated above, the embodiment controls the ratio of the collected toner in the casing 4*a* to less than 20% at all times. This prevents the characteristic of the developer in the casing 4*a* from noticeably changing and, therefore, insures attractive images over a long period of time while eliminating defective image transfer and defective cleaning.

[6th Embodiment]

A sixth embodiment of the present invention is similar to the fifth embodiment except that control means is included for changing the ratio of the collected toner to be supplied to the casing 4*a* on the basis of the toner concentration which is determined in terms of the output of the P sensor 18. The frictional chargeablity of the collected toner tends to decrease, compared to that of the fresh toner, as stated earlier. When the toner concentration of the developer in the casing 4*a* is lowered to in turn increase the amount of charge deposition on the toner, the frictional charging of the collected toner is further obstructed by the fresh toner. The collected toner with short charge would contaminate the background or would be scattered around. In the sixth embodiment, when the toner concentration of the developer in the casing 4*a* is lower than a reference value as indicated by the output of the P sensor 18, the solenoids associated with the collected toner supplement roller 92*a* and fresh toner supplement roller 91*a* are turned on to rotate each of the rollers 92*a* and 91*a* over a particular duration. At this instant, the ratio of the collected toner to be fed to the casing 4*a* is changed in matching relation to the difference between the actual toner concentration and the reference value. Specifically, as the decrease of the toner concentration from the reference value increases, the ratio of the collected toner to the entire toner is sequentially reduced to 20%, 15% and 10%.

As stated above, when the actual toner concentration in the casing 4*a* is noticeably lower than the reference value, the embodiment reduces the amount of the collected toner whose frictional chargeability has been aggravated by the fresh toner. This is successful in preventing the toner from contaminating the background or being scattered around and, therefore, in insuring more stable image quality over a long period of time.

[7th Embodiment]

A seventh embodiment is essentially similar to the sixth embodiment except for the following. In the seventh embodiment, when the toner concentration in the casing 4*a* is reduced to below a predetermined minimum reference value, control means interrupts the supplement of the collected toner to the casing 4*a* and allows only the fresh toner to be supplemented. For example, the toner concentration of the developer in the casing 4*a* is determined on the basis of the output of the P sensor 18 which is inversely proportional to the amount of toner deposition on the drum 1, i.e., the toner concentration in the casing 4*a*. Hence, when the output of the P sensor 18 exceeds a predetermined maximum reference value, the rotation of the supplement roller 92*a* is stopped while the supplement roller 91*a* is rotated to feed only the fresh toner to the casing 4*a*.

As stated above, when the toner concentration in the casing 4*a* is extremely low, the embodiment stops supplementing the collected toner to the casing 4*a* to further reduce the amount of the collected toner whose frictional chargeability has been aggravated by the fresh toner. The embodiment, therefore, more surely prevents the toner from contaminating the background or being scattered around, thereby minimizing the degradation of image quality.

In the fifth to seventh embodiments, the durations of rotation of the toner supplement rollers 91*a* and 92*a* are changed to control the amount of toner supplement to the casing 4*a*. Alternatively, the numbers of rotation of the rollers 91*a* and 92*a* per unit time may be changed in place of the durations. Further, the P sensor 18 may be replaced with a sensor directly mounted on the casing 4*a* for sensing the amount of toner remaining in the casing 4*a*.

[8th Embodiment]

Figure 10A:
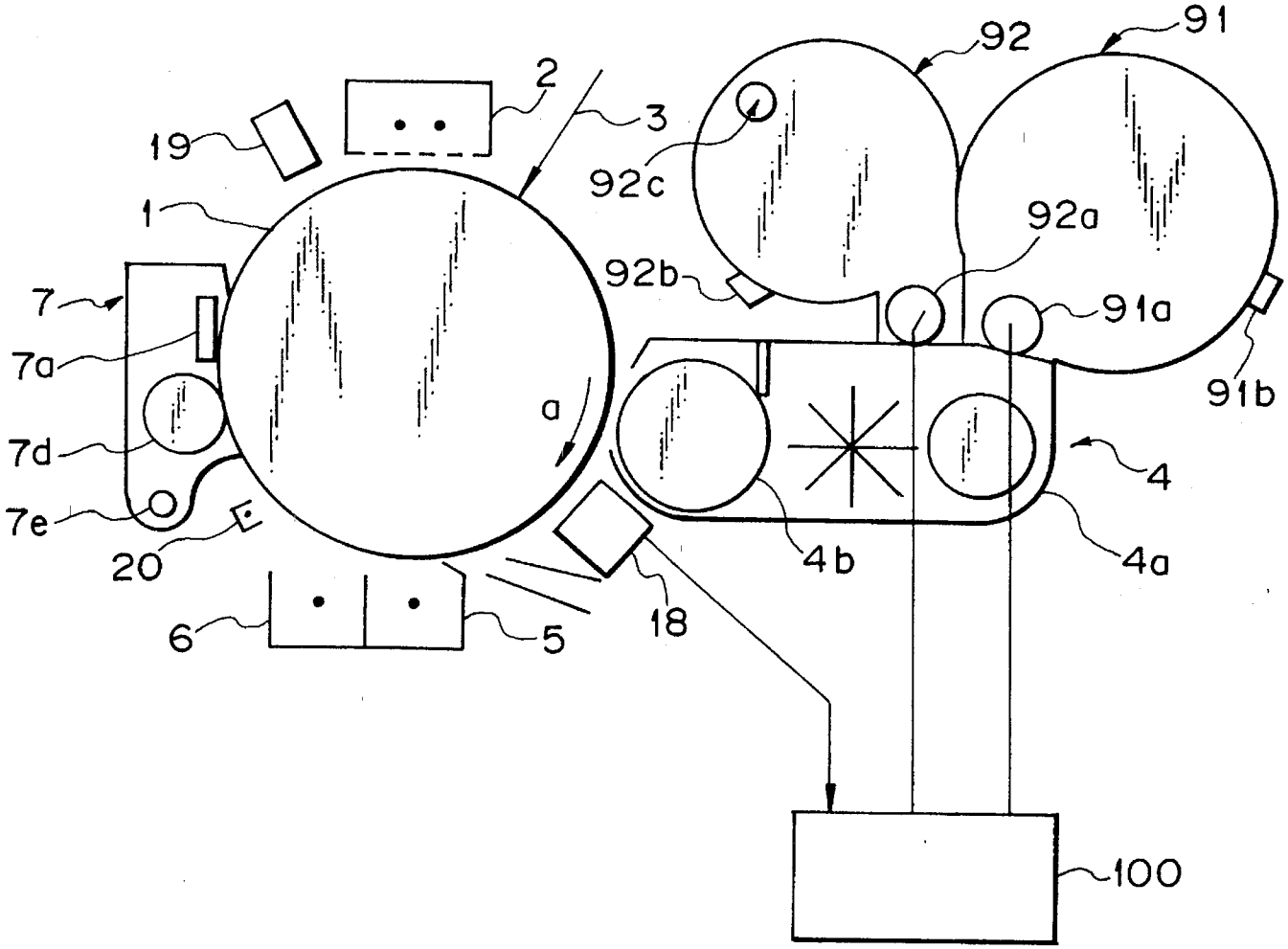
FIG. 10A shows another alternative embodiment of the present invention.

Referring to FIG. 10A, an eighth embodiment of the present invention is shown. The embodiment uses a reversal development system, i.e., a photoconductive drum or image carrier 1 whose photoconductive layer is implemented by a negatively chargeable OPC and a two component developer containing a negatively chargeable toner. While the drum 1 is rotated in the direction a, the main charger 2 uniformly charges the surface of the drum 1. Laser optics (hereinafter referred to as LD), not shown, scan the charged surface of the drum 1 in the axial direction of the drum 1, i.e., main scanning direction with the laser beam 3 associated with image data. As a result, a latent image associated with the image data is electrostatically formed on the drum 1. The developing unit 4 develops the latent image to produce a corresponding toner image. The surface potential of the drum 1 in the event of development is selected to be about −800 V in the background (dark area potential $V_D$) and about −100 V in the image area (light area potential $V_L$). In the image area, the negatively charged toner deposits due to the difference between the surface potential and a bias voltage $V_B$ of about −600 V applied to the developing roller 4*a* of the developing unit 4, thereby developing the latent image. A filter, not shown, is disposed in the developer path in the developing unit 4 so as to remove paper dust and other impurities from the developer.

The toner image is transferred to a sheet by the transfer charger 5. Then, the sheet is separated from the drum 1 by the separation charger 6. Finally, the toner image on the sheet is fixed by a fixing unit, not shown. Part of the toner image on the drum 1 is left untransferred after the image transfer. A precleaning charger 20 uniformizes the charge of such a remaining toner, and then the cleaning unit 7 removes the toner. The cleaning unit 7 has the cleaning blade 7*a* and a cleaning roller 7*d*, the cleaning roller 7*d* being biased to differ in potential from a potential of the drum 1. The discharge lamp 19 dissipates the charge remaining on the drum 1 by the application of light.

To reuse the toner removed from the drum by the cleaning unit 7, the embodiment has a toner conveyor, not shown, for conveying the toner coming in the cleaning unit 7 through an inlet 7*e*, to the collected toner hopper 92 provided on the top of the developing unit 4. The toner conveyor conveys the collected toner from the cleaning unit 7 to the toner hopper 92. The hopper 92 has the collected toner supplement roller 92*a*, a sensor 92*b* and a toner inlet 92*c*. The supplement roller 92*a* forms part of toner supplementing means for supplementing the collected toner from the hopper 92 to the casing 4*a*. The sensor 92*b* is responsive to the amount of collected toner in the hopper 92 and implemented by, for example, a piezoelectric sensor. The collected toner from the toner conveyor enters the hopper 92 via the toner inlet 92*c*. The toner hopper 91 for accommodating a fresh toner is also provided on the top of the developing unit 4. The hopper 91 has the supplement roller 91*a* for feeding a fresh toner from the hopper 91 to the casing 4*a*, and a sensor 91*b* responsive to the amount of fresh toner remaining in the hopper 91 and implemented by, for example, a piezoelectric sensor. The supplement rollers 92*a* and 91*a* are driven independently of each other.

Figure 10B:
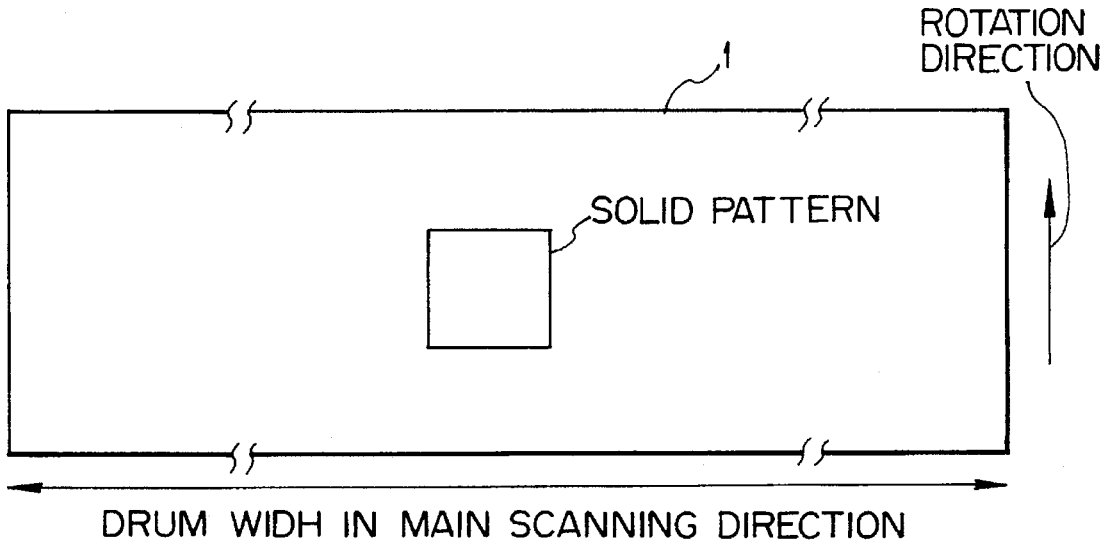
FIG. 10B shows a specific reference density pattern applicable to the embodiment of FIG. 10A.

In the illustrative embodiment, to maintain a desired image density, the toner supply to the casing 4*a* is controlled by use of a reference density pattern, as conventional. Specifically, a latent image representative of the reference density pattern is formed on the drum 1 outside of the image forming area such that the surface potential of the drum 1 is about −800 V in the background (dark area potential $V_{PD}$) and about −250 V in the pattern area (light area potential $V_{PL}$). The latent image is developed based on the difference between the surface potential and a bias potential $V_{PB}$ of about −600 V in the event of image density control. FIG. 10B shows a specific reference density pattern which is a solid pattern of medium potential (e.g. 20 mm×20 mm). The P sensor 18 adjoining the drum 1 outputs a signal voltage $V_{SP}$ representative of a reflectance of the reference density pattern and a signal voltage $V_{SG}$ representative of a reflectance of the background. The ratio $V_{SP}/V_{SG}$ is determined, and then the toner supplement to the casing 4*a* is so effected as to control the image density toward a predetermined level. As a result, the amount of toner deposition on the drum 1 is maintained constant to set up a standard image density.

How the toner is fed from each of the toner hoppers 92 and 91 will be described specifically. In the illustrative embodiment, the amount of collected toner and that of the fresh toner to be fed are determined on the basis of the ratio $V_{SP}/V_{SG}$ of the outputs of the P sensor 18. The background contamination by the toner and the scattering of the toner ascribable to the supplement of the collected toner are closely related to the developing ability of the developing unit, as discussed previously. Specifically, the contamination due to the supplement of the collected toner is more liable to occur as the developing ability, e.g., the toner concentration decreases. Therefore, on the fall of the developing ability of the developing unit, the embodiment reduces the supplementary amount of collected toner instead of increasing it. Consequently, the fall of the developing ability and the decrease in the supplementary amount of collected toner are compensated for by the fresh toner.

To determine the developing ability, the embodiment uses the ratio $V_{SP}/V_{SG}$ of the outputs of the P sensor 18. Specifically, the P sensor 18 determines the amount of toner deposition for a given developing potential, thereby detecting the amount of charge per unit mass (Q/M) of the toner indirectly. This kind of method is feasible for the control over the supplement of the collected toner. Of course, other various methods including one which uses a toner concentration sensor responsive to the permeability of the developer are also known in the art. However, since the relation between the toner concentration and the ratio Q/M depends on the varying ambient conditions, determining the Q/M indirectly is most desirable in determining the supplementary amount of collected toner.

Figure 11A:
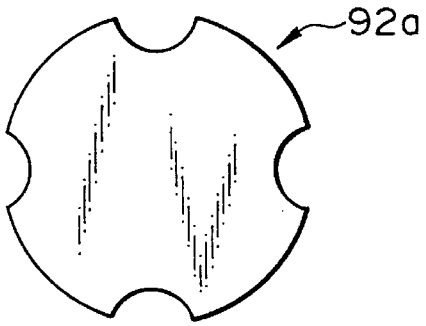
FIGS. 11A and 11B are enlarged views showing respectively a collected toner supplement roller and a fresh toner supplement roller included in the embodiment of FIG. 10A.
Figure 11B:
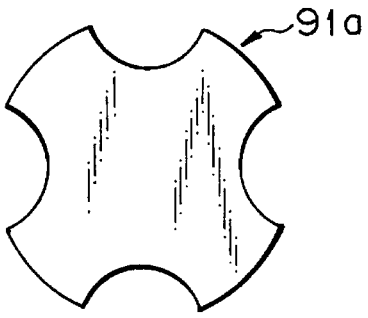

Further, as shown in FIGS. 11A and 11B, the embodiment provides the supplement roller 92*a* with axially extending grooves shallower than the grooves of the supplement roller 91*a*. In this configuration, although the collected toner and the fresh toner are respectively received in the grooves of the supplement rollers 92*a* and 91*a* and transported to the casing 4*a* at the same time, the former is smaller in amount than the latter. At the same time, although the supplement rollers 91*a* and 92*a* are rotated at the same speed, an arrangement is made such that the collected toner supplemented in a smaller amount per unit time than the fresh toner. For example, the collected toner and the fresh toner are supplemented at rates of 250 mg/sec and 500 mg/sec, respectively. This is to promote the mixture of the collected toner with the developer in the casing 4*a*. When the grooves of the supplement roller 92*a* assigned to the collected toner are shallow as shown in FIG. 11A, it may occur that the supplement of the collected toner cannot follow a sharp fall of the toner concentration in the casing 4*a*. In such a case, the embodiment reduces the supplementary amount of collected toner and increases the supplement of fresh toner by a corresponding amount. It is not necessary, therefore, to provide the supplement roller 92*a* with a supplement efficiency as high as that of the supplement roller 91*a*. In addition, since the embodiment starts supplementing the collected toner and fresh toner every time a single copy is produced, the supplement roller 92*a* can be rotated throughout the maximum supplement period which is determined by, for example, the agitating ability particular to the developing section 4*a*. For the above reasons, the decrease in the supplement efficiency of the supplement roller 92*a* does not matter at all.

Figure 12:
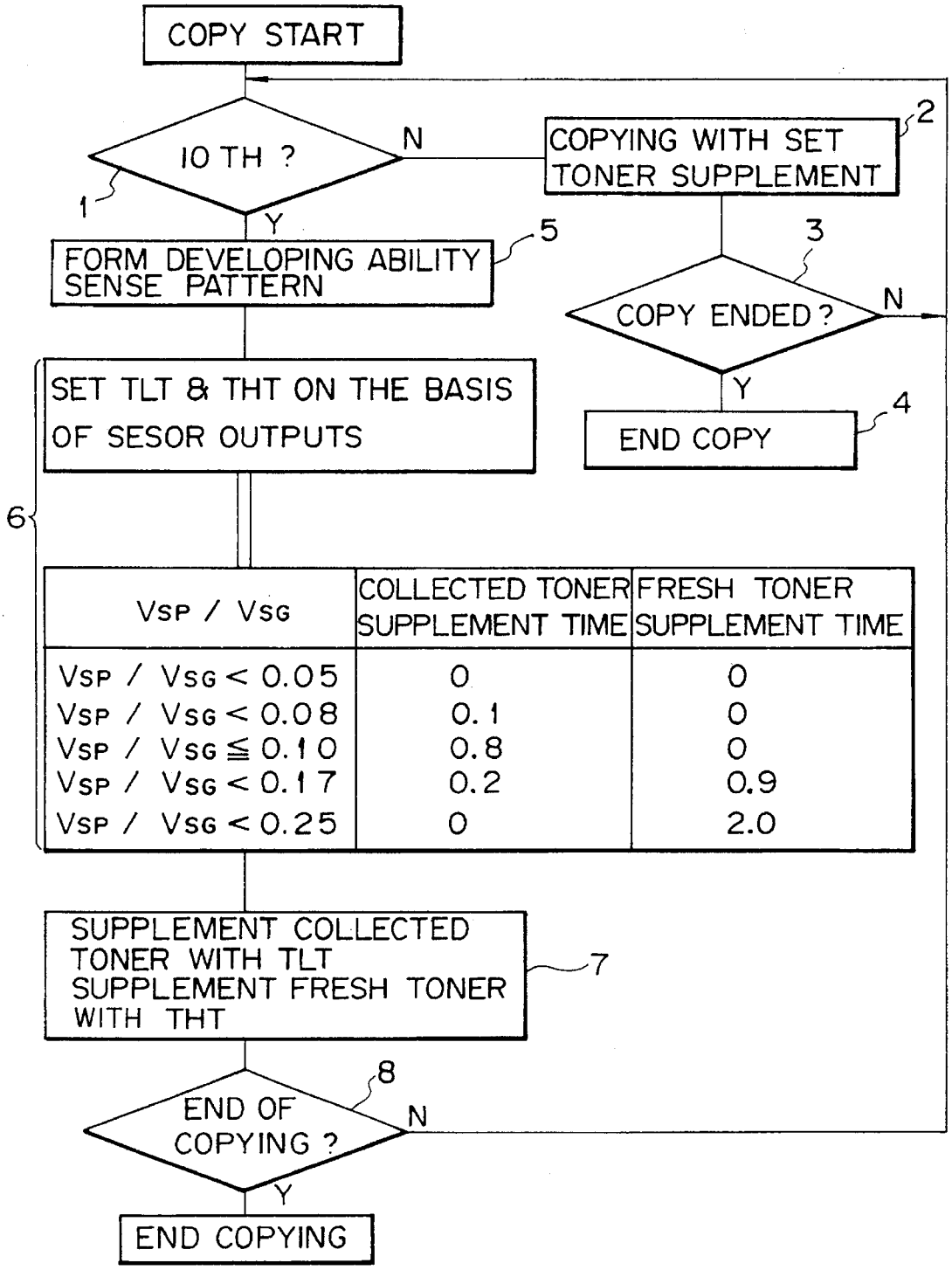
FIG. 12 is a flowchart demonstrating a specific toner supplement control procedure particular to the embodiment of FIG. 10A.

A reference will be made to FIG. 12 for describing a specific control procedure of the illustrative embodiment. On the start of a copying operation, a pattern generation mode is executed with the first copy and the following every tenth copy on the basis of the cumulative number of copies as counted from the time when the power switch was turned on (Y, step 1). With the other copies, a usual copy mode is executed (steps 2, 3 and 4). Even during the usual copy mode operation, toner supplement is effected over particular periods of time which will be described (step 2). It is to be noted that the output of the P sensor 18 is automatically adjusted by an electronic volume such that it is 4 V when a reflection from the drum 1 is sensed every 100 copies without development.

In the pattern generation mode, a pattern for determining the developing ability, i.e., the reference density pattern in this case, is formed (step 5). Assuming that the ratio $V_{SP}/V_{SP}$ of the resulting outputs of the P sensor 18 is 0.12 by way of example, then the collected toner is supplemented for 0.2 second (TLT) for the next ten copies. In this case, the fresh toner is supplemented for 0.9 second (THT) per copy (steps 6 and 7). The collected toner and the fresh toner are repetitively supplemented in this fashion until the next pattern has been formed. The durations of drive of the supplement rollers 92*a* and 91*a* are controlled by a microcomputer or similar controller 100, FIG. 10A.

As stated above, by determining the developing ability, this embodiment achieves both of the reuse of the toner, i.e., the efficient use of limited resources, and the elimination of defective images.

[9th Embodiment]

A ninth embodiment sets the upper limit of the supplementary amount of collected toner by forming a particular pattern for determining the amount of defective toner, e.g., insufficiently charged toner and inversely charged toner, existing in the casing 4*a* (referred to as defective toner concentration sense pattern hereinafter) on the drum 1 in addition to the above-stated pattern. The defective toner concentration sense pattern is electrostatically formed in the same manner as the image density control pattern such that the surface potential of the drum 1 is about −850 V in the background (dark area potential $V_{NPD}$) and about −550 V in the pattern area (light area potential $V_{NPL}$). This pattern is developed due to the difference between the surface potential and a bias voltage $V_{NPB}$ of about −600 V. The defective toner concentration sense pattern may also be implemented as a solid pattern (20 mm×20 mm). As a result, the P sensor outputs a signal voltage $V_{NSP}$ representative of a reflection from the toner image of the sense pattern and a signal voltae $V_{NSG}$ representative of a reflection from the background. The upper limit of the supplementary amount of collected toner is set on the basis of the sensor outputs $V_{NSP}$ and $V_{NSG}$.

Figure 13:
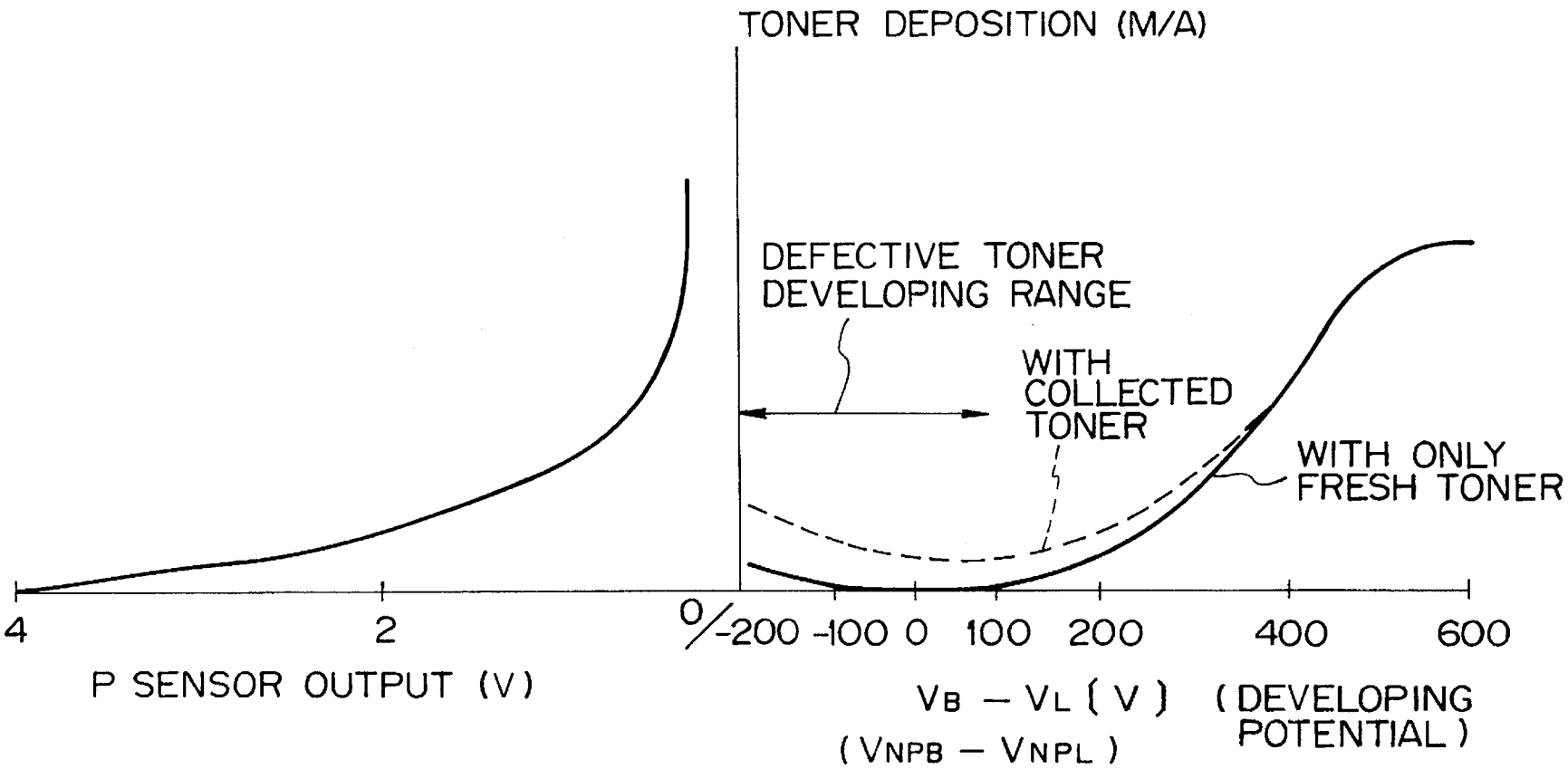
FIG. 13 is a graph indicative of a relation between the developing potential and P sensor output and the amount of toner deposition achievable with the embodiment of FIG. 10A.

Although the reuse of the toner remaining on the drum 1 saves resources, it makes the toner difficult to charge due to deterioration and causes part of the toner to be inversely charged. This causes the toner to contaminate the background or to fly out of the developing unit 4. Further, in a low contrast portion, the toner deposits in an amount greater than a designed amount. Moreover, these occurrences are effected by changes in the potential of the drum 1 and the deterioration of the carrier which are in turn ascribable to aging and-varying ambient conditions. Therefore, to use the collected toner efficiently, it is necessary not only to control the supplement of the collected toner in matching relation to the developing ability but also to determine the aptness (degree) of the undesirable occurrences at the earliest possible stage. As shown in FIG. 13 specifically, the amount of toner deposition for a given developing potential differs from the case using the collected toner to the case not using it. This causes the toner to deposit on the background.

Figure 14A:
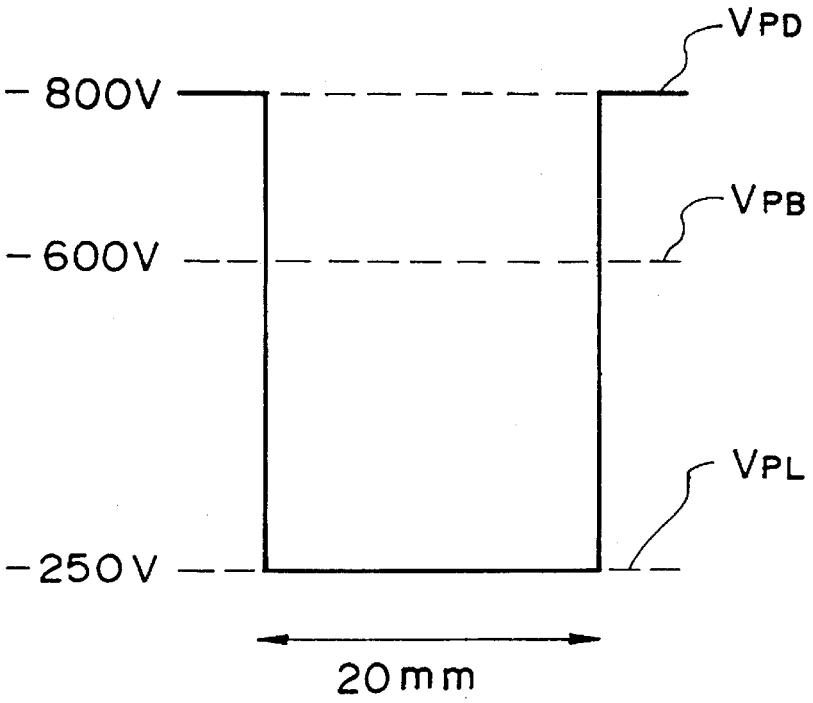
FIG. 14A shows an image forming condition for forming a reference density pattern.
Figure 14B:
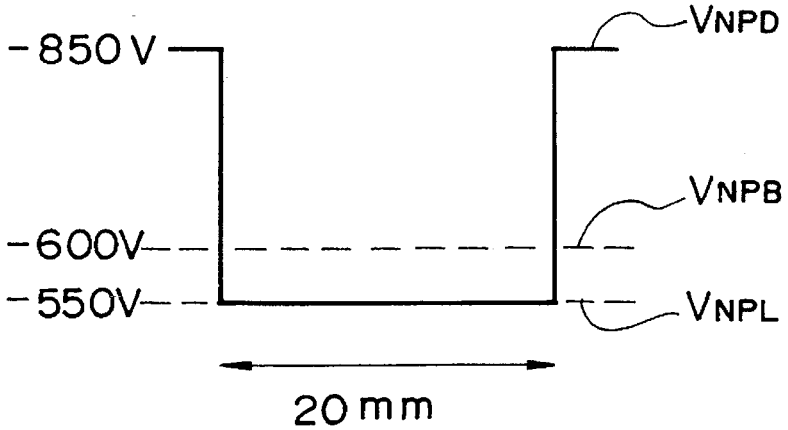
FIG. 14B shows an image forming condition particular to another alternative embodiment of the present invention.

To detect the toner apt to cause the undesirable occurrences at the earliest possible stage, this embodiment forms the defective toner concentration sense pattern in a low toner deposition range in which the sensitivity of the P sensor 18 is high. Specifically, as shown in FIG. 14B, regarding the inversely charged toner, the potential $V_{NPD}$ is slightly intensified to the negative side to a degree which does not cause the carrier to deposit while, regarding the insufficiently charged toner, the potential $V_{NPL}$ is set at or around the bias for development (within 100 V). FIG. 14A shows conditions for forming the reference density pattern for comparison. Based on the result of detection, the embodiment controls the supplement of the fresh toner and collected toner.

It is to be noted that the potentials $V_{NPD}$ and $V_{NPL}$ shown in FIG. 14B are only illustrative and hold when the bias voltage for development is constant. The gist is that the difference between the background potential ($V_{NPD}$) associated with the defective toner concentration sense pattern and the bias voltage ($V_{NPB}$) is made greater than the difference between the background potential (VB) associated with ordinary images and the bias voltage (VB) so as to detect an inversely charged toner, and that the black area potential ($V_{NPL}$) associated with the sense pattern lies within the range of 100 V from the bias ($V_{NPB}$) so as to detect an insufficiently charged toner. Potentials $V_{NPD}$, $V_{NPB}$ and $V_{NPL}$ other than the above-mentioned potentials would be problematic. For example, assume that the sense pattern is formed by the same bias voltage as ordinary images. Then, if the potential $V_{NPD}$ is excessively intensified to the negative side and far different from the bias voltae $V_{NPB}$ (e.g.

exceeds 300 V), the carrier will deposit on the drum 1. Conversely, if the potential $V_{NPD}$ is excessively low, it will be difficult to detect the defective toner at an early stage. Further, assume that the potential VNPL is excessively high to the negative side and orients the electric field between the black portion of the latent image in a direction for causing the toner of adequate polarity to move toward the developing roller 4*b* and provide the field with an excessive size. Then, the amount of insufficiently charged toner to deposit will be too small to detect. Conversely, if the potential VNPL is excessively low to orient the electric field between the black portion of the latent image and the roller 4*b* in a direction for causing the toner of adequate polarity to move toward the drum 1 and provide the field with an excessive size, the defective toner and the adequate toner cannot be readily distinguished.

Figures 15, 15A:
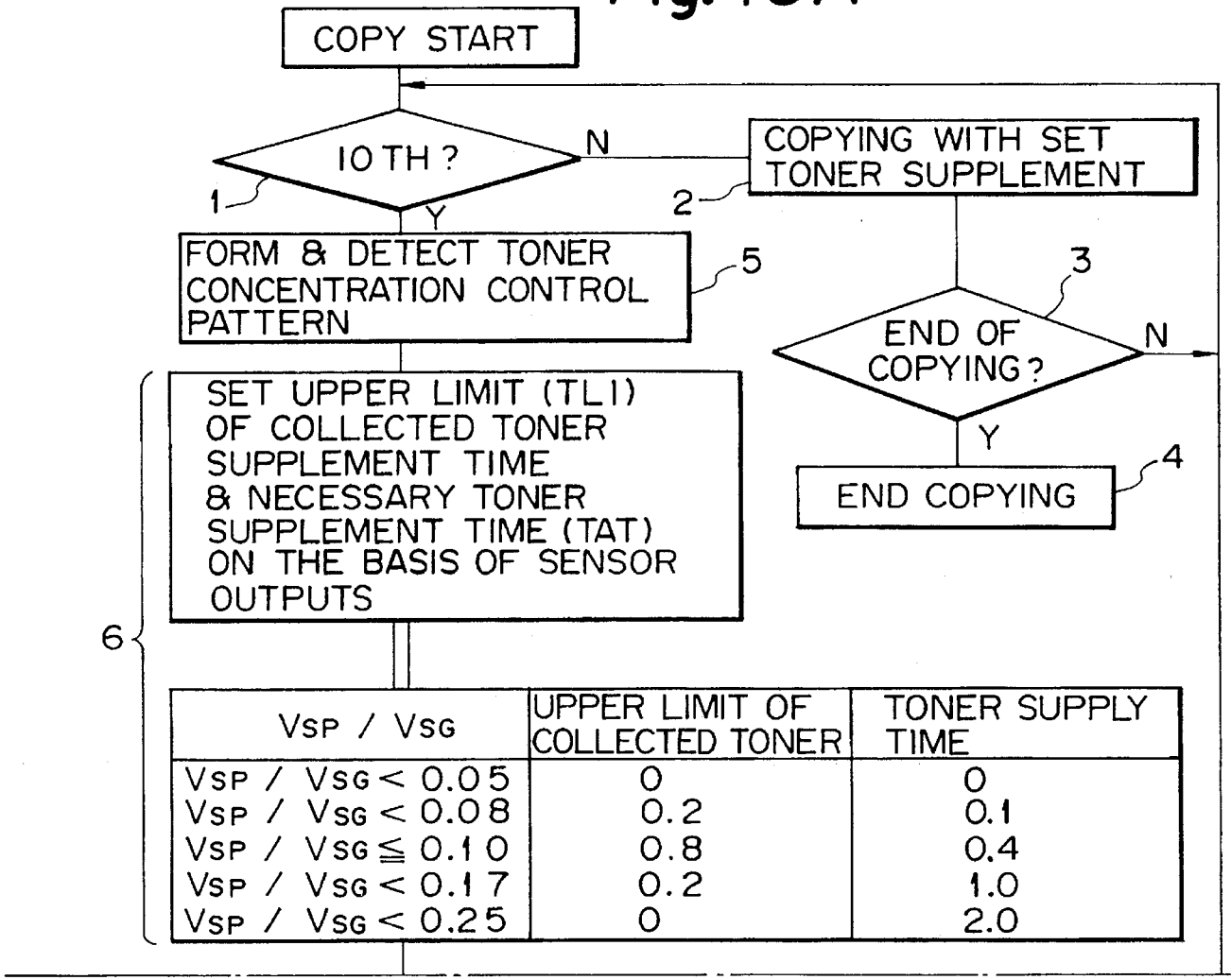
FIG. 15 is a flowchart representative of a specific toner supplement control procedure associated with FIG. 14B.
Figure 15B:
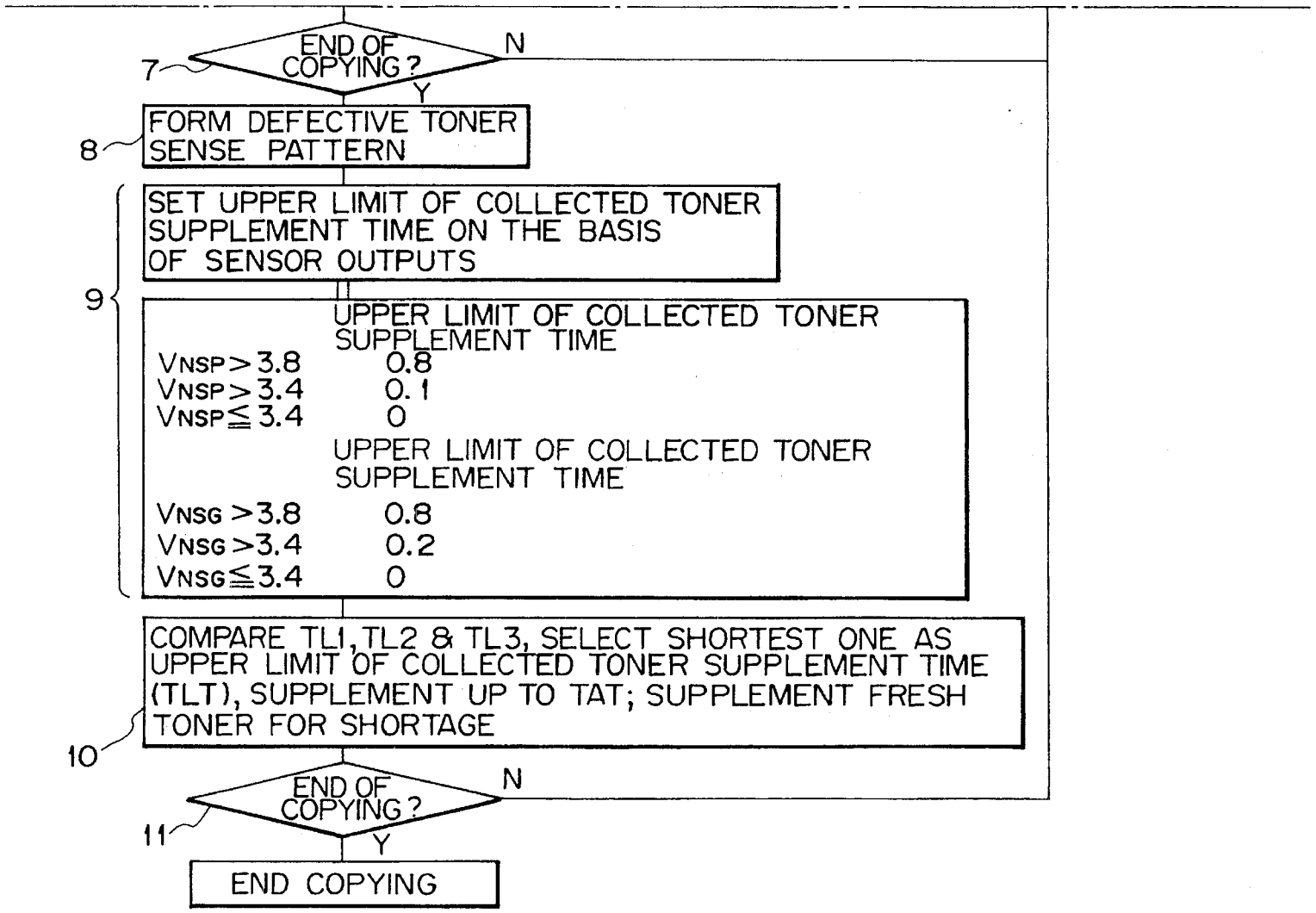

A reference will be made to FIG. 15 for describing a specific control procedure of the ninth embodiment. On the start of a copying operation, a pattern generation mode is executed with the first copy and the following every tenth copy on the basis of the cumulative number of copies as counted from the time when the power switch was turned on (Y, step 1), as in the eighth embodiment. With the other copies, a usual copy mode is executed (steps 2, 3 and 4). The output of the P sensor 18 is automatically adjusted by an electronic volume such that it is 4 V when a reflection from the drum 1 is sensed every 100 copies without development.

In the pattern generation mode, the pattern for determining the developing ability is formed (step 5). If the ratio $V_{SP}/V_{SG}$ of the resulting outputs of the P sensor 18 is, for example, 0.12, 1.0 second is set as the duration of total toner supplement (TAT) per copy for the next ten copies. In this case, the upper limit (TL1) of the duration of the supplement of the collected toner is set at 0.3 second (step 6). Subsequently, the defective toner concentration sense pattern is formed under the previously stated conditions. In response to the resulting outputs of the P sensor 18, the upper limits of supplement time (TL2 and TL3) for the next and successive supplements of collected toner are determined (steps 8 and 9). Then, the upper limits TL1, TL2 and TL3 are compared to select the shortest one as the toner supply time (TAT). The shortage of the total toner supply time is set as a supplement time for the fresh toner, whereby the fresh toner is supplemented (steps 10 and 11). For example, when $V_{NSP}$ and $V_{NSG}$ are 3.5 and 3.9, respectively, TL2 and TL3 are 0.1 and 0.8, respectively. Then, assuming that TL1 is 0.2, TL2 which is 0.1 second is selected as the supplement time of collected toner while the supplement time of fresh toner is 1.0–0.1 /2=0.95 second (the difference is divided by 2 since the supplement efficiency of the supplement roller 91*a* is twice as high as that of the supplement roller 92*a*).

In the embodiment, the concentration of defective toner is sensed once every time ten copies are produced and after the detection of the developing ability. However, the frequency may be changed in matching relation to the frequency of occurrence of defective toner. Further, if the concentration cannot be sensed frequently due to the hardware limitations of the copier, the duration of collection may be extended to implement a period of, for example 1000 copies.

[10th Embodiment]

A tenth embodiment is similar to the eighth embodiment except for the time for causing the independent toner supplementing means to start supplementing the fresh toner and the collected toner. Briefly, this embodiment supplements the fresh toner for a set period of time and then supplements the collected toner.

The toner undergone repetitive collection and reuse is difficult to charge due to deterioration, as stated earlier. As the toner concentration in the casing 4*a* decreases, the ratio of the amount of charge per unit mass Q/M of the toner in the casing 4*a* increases with the result that the electrostatic force acting between the toner and the carrier is intensified. This obstructs the charging of the toner existing in the casing 4*a* due to the friction with the collected toner. It follows that supplementing the collected toner when Q/M in the casing 4*a* is high, i.e., when the developing ability is low, causes the toner to contaminate the background or to be scattered around. To eliminate this problem, even when the developing ability is low, the embodiment supplements the fresh toner to increase the developing ability and then supplements the collected toner. The embodiment, therefore, can supplement a greater amount of collected toner when the developing ability is lowered than the eighth and ninth embodiments, thereby enhancing the efficient use of collected toner.

Figure 16:
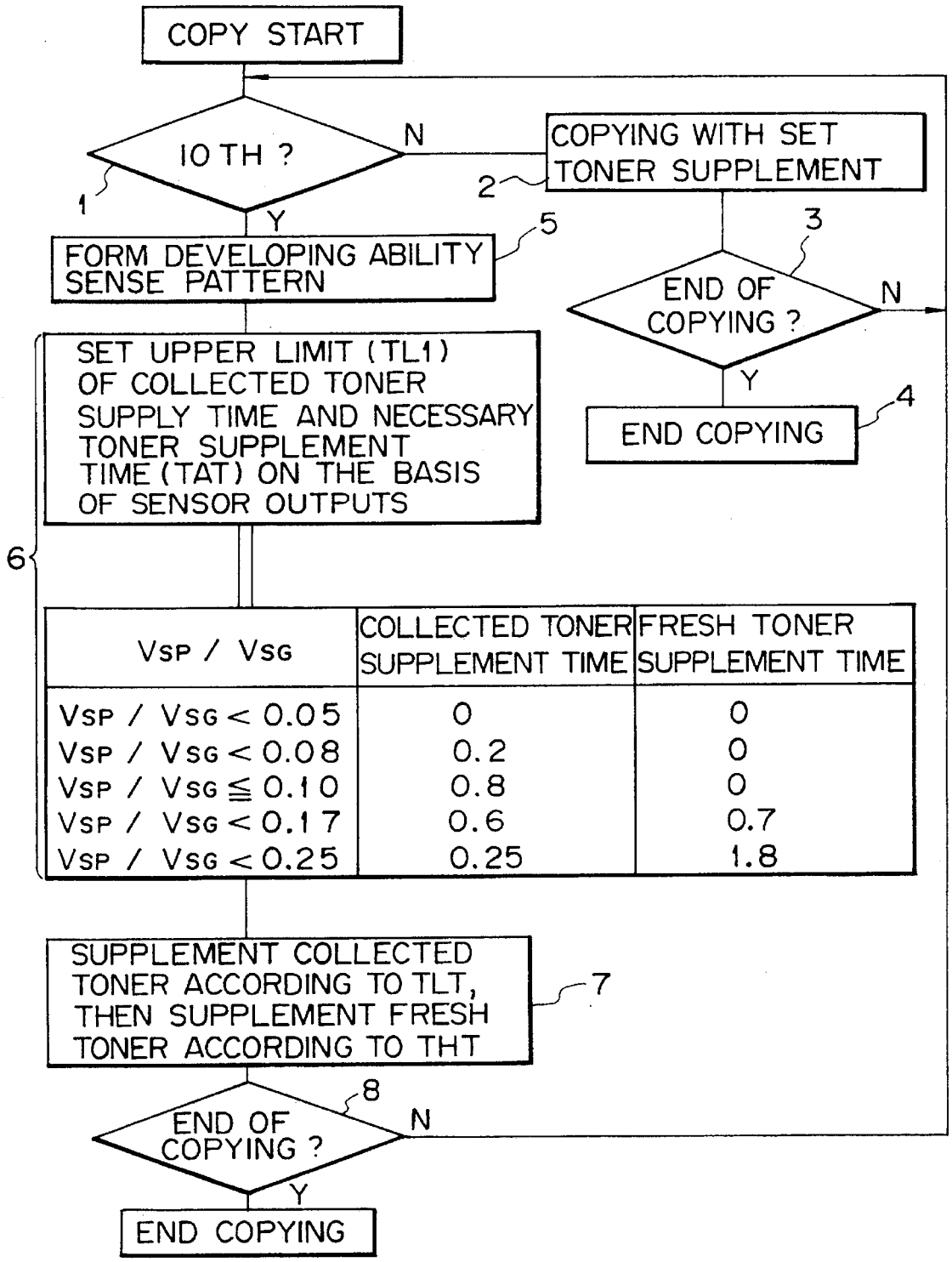
FIG. 16 is a flowchart representative of another alternative embodiment of the present invention.

A specific operation of the tenth embodiment will be described with reference to FIG. 16. On the start of a copying operation, a pattern generation mode is executed with the first copy and the following every tenth copy on the basis of the cumulative number of copies as counted from the time when the power switch was turned on (Y, step 1), as in the eighth embodiment. With the other copies, a usual copy mode is executed (steps 2, 3 and 4). The output of the P sensor 18 is automatically adjusted by an electronic volume such that it is 4 V when a reflection from the drum 1 is sensed every 100 copies without development.

In the pattern generation mode, the pattern for determining the developing ability is formed first (step 5). When the resulting outputs of the P sensor 18 indicate VSP/VSG=0.12, the collected toner supplement time (TLT) is set at 0.6 second for the next ten copies. Regarding the fresh toner, a supplement time (THT) of 0.7 second is set for each copy (steps 6 and 7). The collected toner and fresh toner are supplemented in this way until the next pattern for determining the developing ability has been formed (steps 1, 2, 3 and 4). If the amount of remaining collected toner sensed by the sensor 92*b* is lower than a predetermined level, only the fresh toner is supplemented for a period of time of 0.6/2+0.7=1.0 second.

[11th Embodiment]

Figure 18:
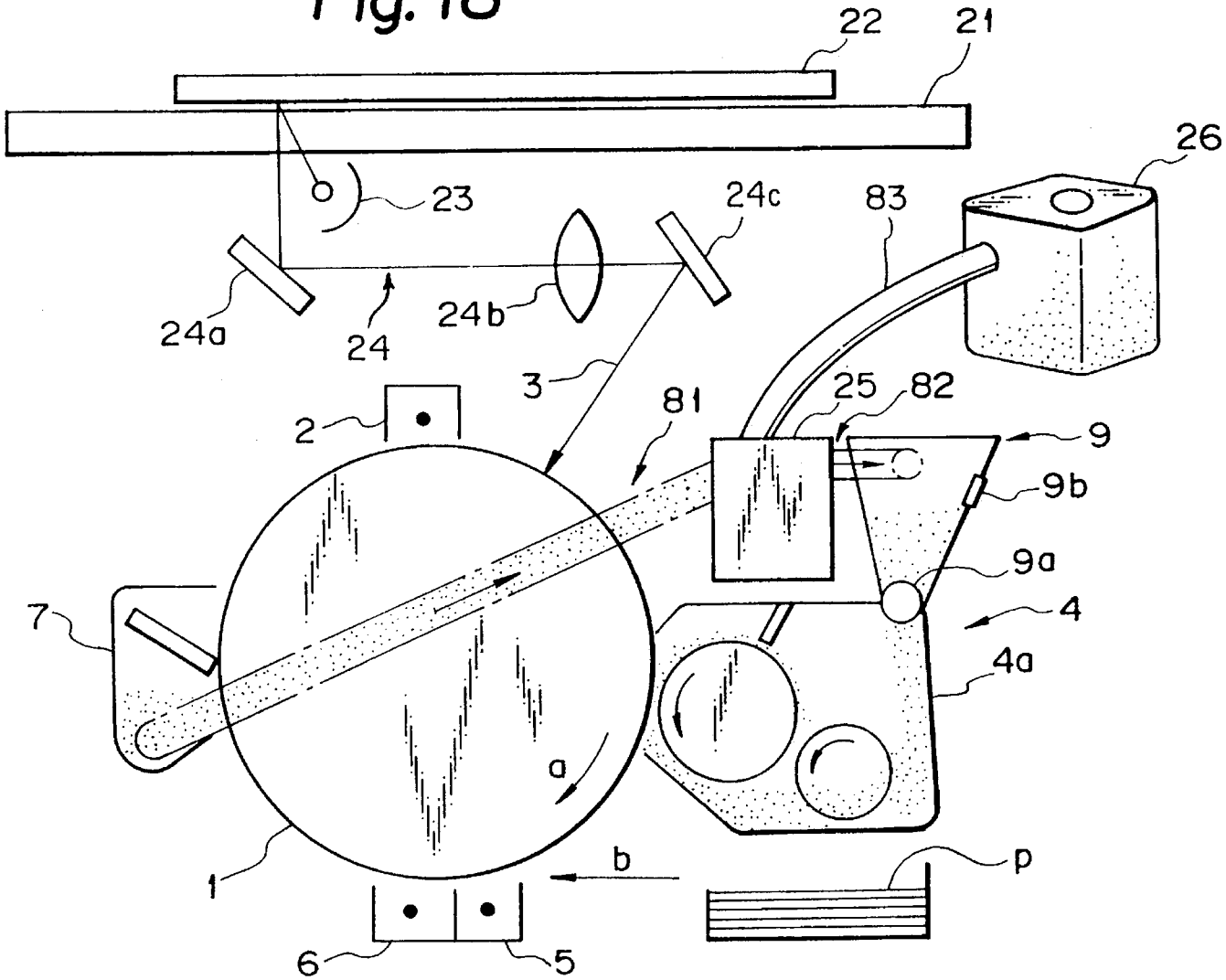
FIG. 18 shows another alternative embodiment of the present invention.

FIG. 18 shows an eleventh embodiment of the present invention. As shown, a light source 23 scans a document 22 laid on the glass platen 21. The resulting reflection from the document 22 is propagated through optics 24 including mirrors 24*a* and 24*c* and a lens 24*b* to the drum 1 which is rotating in the direction a. The surface of the drum 1 has been uniformly charged by the main charger 2. As a result, a latent image representative of the document 22 is electrostatically formed on the drum 1. The latent image is developed by the developing device 4 and is then transferred to a paper P by the transfer charger 5. Subsequently, the paper P is separated from the drum 1 by the separation charger 6, fixed by a fixing unit, not shown, and then driven out of the copier.

The cleaning unit 7 is located downstream of the transfer charger 5 for removing the toner remaining on the drum 1 after the image transfer. The toner collected by the cleaning unit 7 is transported to the developing unit 4 by a first and a second toner conveyor 81 and 82. Specifically, the toner conveyor 81 conveys the toner from the cleaning unit 7 to a transit receptacle 25 by a stream of air. The other toner conveyor 82 conveys the toner from the transit receptacle 25 to the developing unit 4 by a stream of air. As a result, the toner collected by the cleaning unit 7 is reused for development. At the same time, part of the collected toner is transported from the transit receptacle 25 to a waste toner container 26 by a third toner conveyor 83 also using a stream of air and is then discarded. The toner conveyors 81, 82 and 83 are each operated at a particular timing by a toner transport control section 27, FIG. 19, associated with the transit receptacle 25. The toner hopper 9 provided on the top of the developing unit 4 has an air vent 9*b* for releasing the air fed under pressure. This allows the collected toner to be efficiently returned to the developing unit 4.

Figure 19:
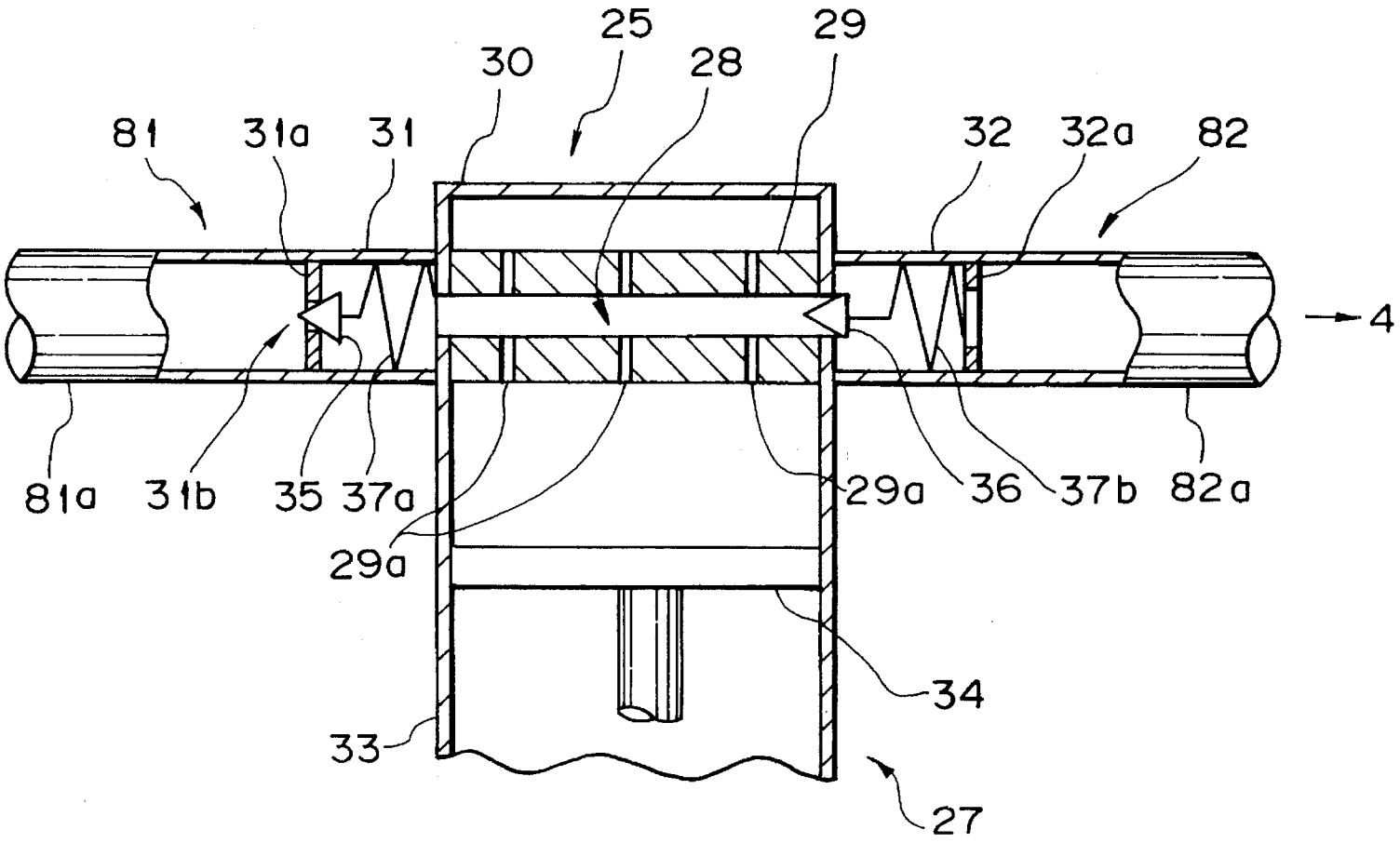
FIG. 19 is a fragmentary section of the embodiment of FIG. 18.

FIG. 19 shows a specific construction of the transit receptacle 25 intervening between the first and second toner conveyors 81 and 82. As shown, the transit receptacle 25 has a storing portion, or temporary storing means, 28 implemented as a bore extending throughout a tubular element 29. Pores 29*a* radially extend throughout the wall of the tubular element 29, and each has a diameter smaller than the diameter of the toner. The element 29 is disposed in a hermetically sealed casing 30. The first toner conveyor 81 has a tube (suction tube) 81*a* which is communicated at one end thereof to a connecting tube 31 which forms one open end of the transit receptacle 25. Likewise, the second toner conveyor 82 has a tube (exhaust tube) 82*a* which is communicated at one end thereof to a connecting tube 32 which forms another open end of the transit receptacle 25. The toner transport control section 27 has a hollow cylinder 33 forming part of the casing 30 and extending in the up-and-down direction. A piston 34 is movable in the cylinder 33 in a reciprocating motion and is held in air-tight contact with the inner wall of the cylinder 33. Check valves 35 and 36 are located on the suction side and the exhaust side, respectively. The check valve 35 is constantly urged by a spring 37*a* against a hole 31*b* formed through a valve seat 31*a* which is disposed in the connecting tube 31. A spring 37*b* is anchored at one end to a projection 32*a* extending out from the inner wall of the connecting tube 32. The spring 37*b* constantly biases the check valve 36 toward the exhaust opening of the transit receptacle 25.

In operation, when the piston 34 is moved downward as viewed in FIG. 19, air in the transit receptacle 25 is sucked out of the tubular element 29 via the pores 29*a*. At the same time, the check valve 35 on the suction side is opened to suck the collected toner from the cleaning unit 7 into the tubular element 29. When the piston 34 is moved upward, air is forcibly introduced into the storing portion 28 via the pores 29*a*. The resulting stream of air under high pressure entrains the toner deposited on the inner wall of the element 29 and transports it to the developing unit 4 by forcing the check valve 36 open. The toner transport control section 27 includes a motor or similar drive source for moving the piston 34, and a control circuit for controlling the drive source. This is also true with all of the embodiments to be described.

Figure 20A:
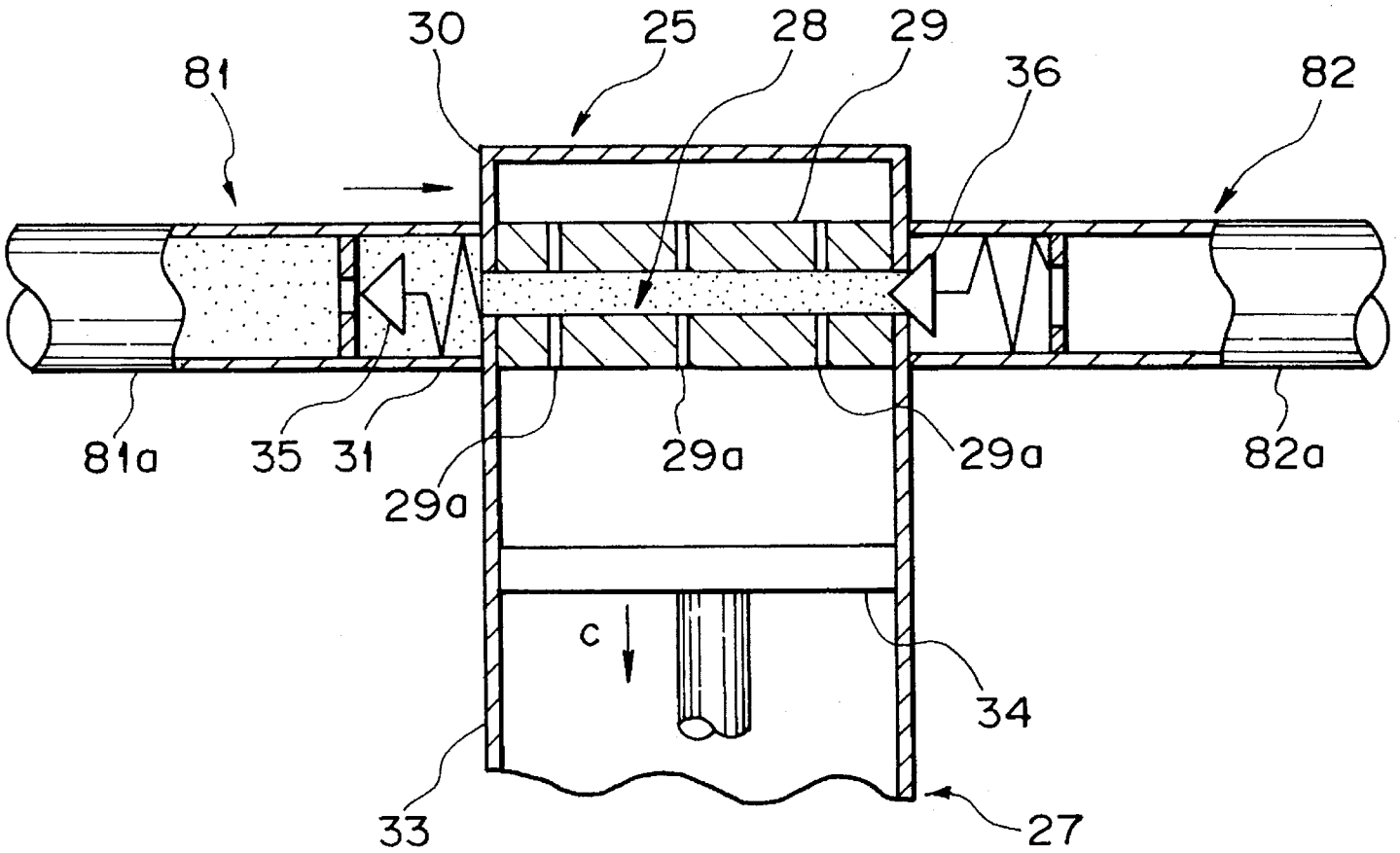
FIGS. 20A and 20B are fragmentary sections demonstrating the operation of the embodiment shown in FIG. 18.
Figure 20B:
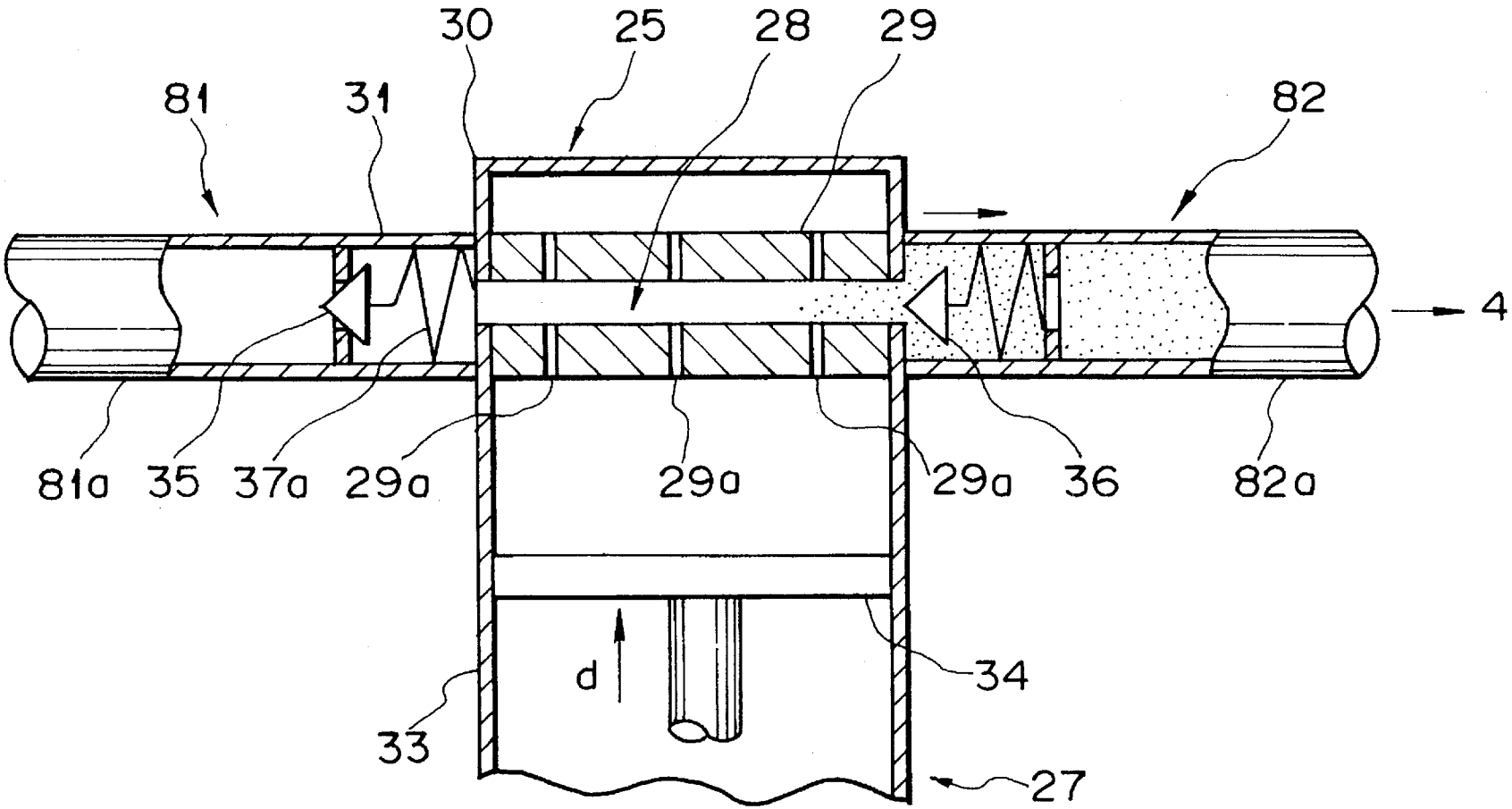

FIGS. 20A and 20B demonstrate the operation of the toner transport control section 27 of the transit receptacle 25 specifically. As shown in FIG. 20A, as the piston 34 moves in the cylinder 33 in the suction direction indicated by an arrow c, air inside the tubular element 29 is sucked to the outside via the pores 29*a*. At the same time, the check valve 35 on the suction side is opened against the action of the spring 37*a* with the result that the collected toner from the cleaning unit 7 is sucked into the element 29 and deposited on the inner wall of the element 29. At this instant, the check valve 36 on the exhaust side remains closed. This part of the operation is effected while the cleaning unit 7 is operating for removing the toner from the drum 1 after image transfer. More specifically, the first toner conveyor 81 is operated during the course of image formation. As shown in FIG. 20B, as the piston 34 moves in the exhaust direction indicated by an arrow d, air is blown into the storing portion 28 under high pressure via the pores 29*a*. This stream of air removes the toner from the inner wall of the element 29 and conveys it to the developing unit 4 by opening the check valve 36. At this instant, the check valve 35 on the suction side has been closed. This part of the operation is performed while a latent image is not developed so as to reuse the toner temporarily stored in the transit receptacle 25. More specifically, the second toner conveyor 82 is operated when the developing unit 4 is not forming an image.

The first toner conveyor 81 should preferably transport the collected toner to the transit receptacle 25 as rapidly as possible to make the cleaning unit 7 compact. Conversely, the toner stored in the transit receptacle 25 should preferably be returned to the developing unit 4 as slowly as possible. For this reason, the transport speed of the second toner conveyor 82 is selected to be lower than that of the first toner conveyor 81. This can be done if the moving speed of the piston 34, the diameters of the suction tube 81*a* and exhaust tube 82*a* or the like is changed.

As stated above, this embodiment conveys the collected toner from the cleaning unit 7 to the developing unit 4 by using streams of air, thereby freeing the toner from excessive loads particular to mechanical transport. As a result, the particle size distribution of the toner is prevented from broadening. A broader particle size distribution would contaminate the background, cause the toner to be scattered around, and cause a solid image from being partly left blank in spots. The first toner conveyor 81 is activated at the time of image formation while the second toner conveyor 82 is activated when image formation is not under way. This allows the toner removed from the drum 1 by the cleaning unit 7 to be efficiently collected and insures sufficient agitation of the collected toner in the developing unit 4. The air streams used in place of mechanical transport members promote efficient transport, compared to mechanical transport members. The toner conveyor 81 transports the toner at higher speed than the toner conveyor 82 so as to collect the toner of the cleaning unit 7 rapidly. This makes the cleaning unit 7 compact and prevents the collected toner from being pulverized. Further, since the toner conveyor 82 returns the collected toner to the developing unit 4 little by little, the collected toner can be sufficiently agitated.

[12th Embodiment]

Figure 21:
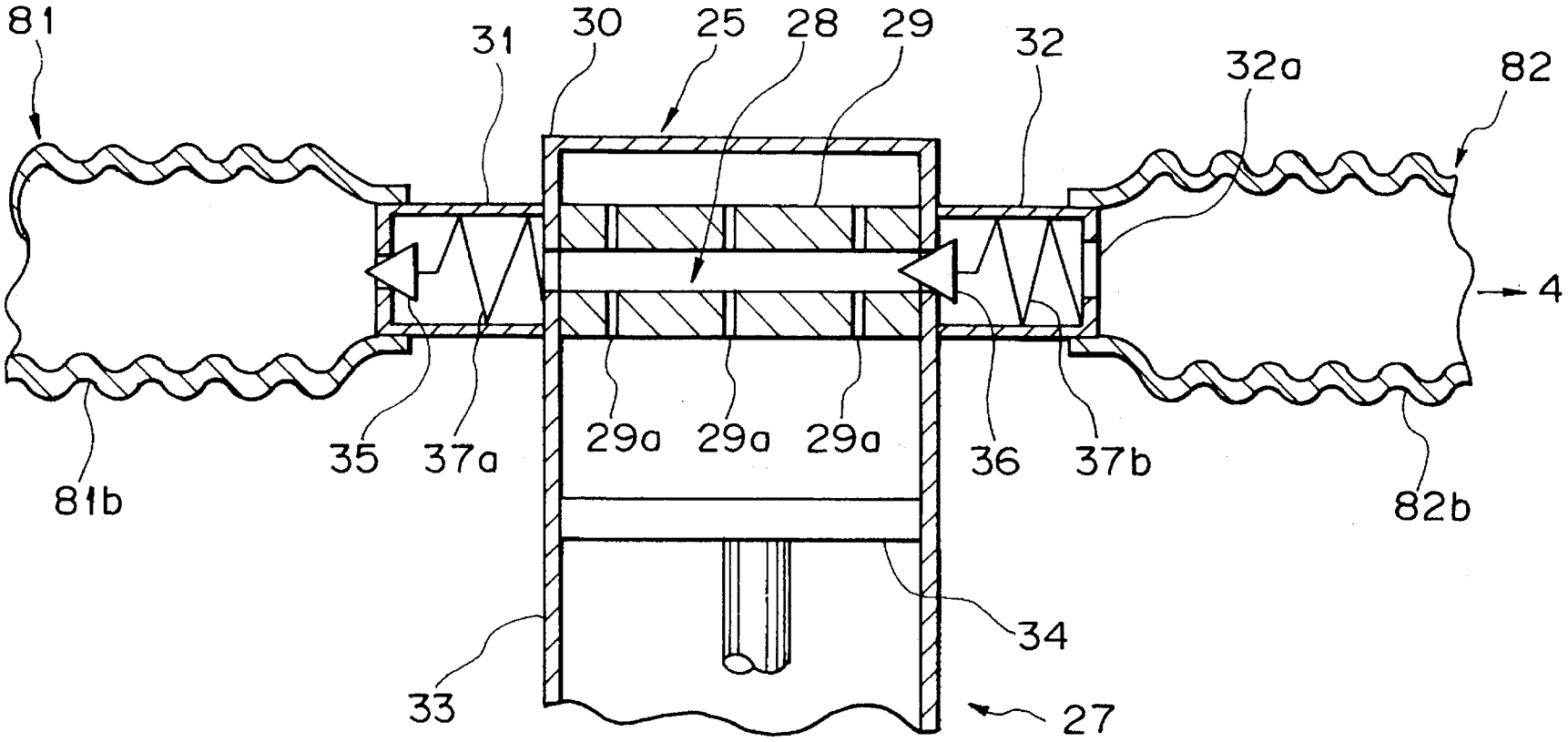
FIGS. 21 and 22 are fragmentary sections each showing another alternative embodiment of the present invention.

FIG. 21 shows a twelfth embodiment of the present invention, particularly a specific construction of the transit receptacle 25. As shown, the connecting tube 31 on the suction side is communicated to one open end of a bellows 81*b* which forms the suction path of the first toner conveyor 81. Likewise, the connecting tube 32 on the exhaust side is communicated to a bellows 82*b* which forms the transport path of the second toner conveyor 82. The rest of the construction is identical with the eleventh embodiment.

This embodiment has an advantage that since both of the bellows 81*b* and 82*b* are flexible, the suction path and exhaust path can be freely designed. The grooves existing on the inner walls of the bellows 81*b* and 82*b* capture or filter out paper dust, pulverized toner particles and other impurities. This implements a compact copier capable of filtering out such impurities. In addition, the bellows 81*b* and 82*b* can be cleaned and then attached again or replaced with new bellows. If desired, only part of the transport paths of the toner conveyors 81 and 82 may be implemented by the bellows 81*b* and 82*b*.

[13th Embodiment]

Figure 22:
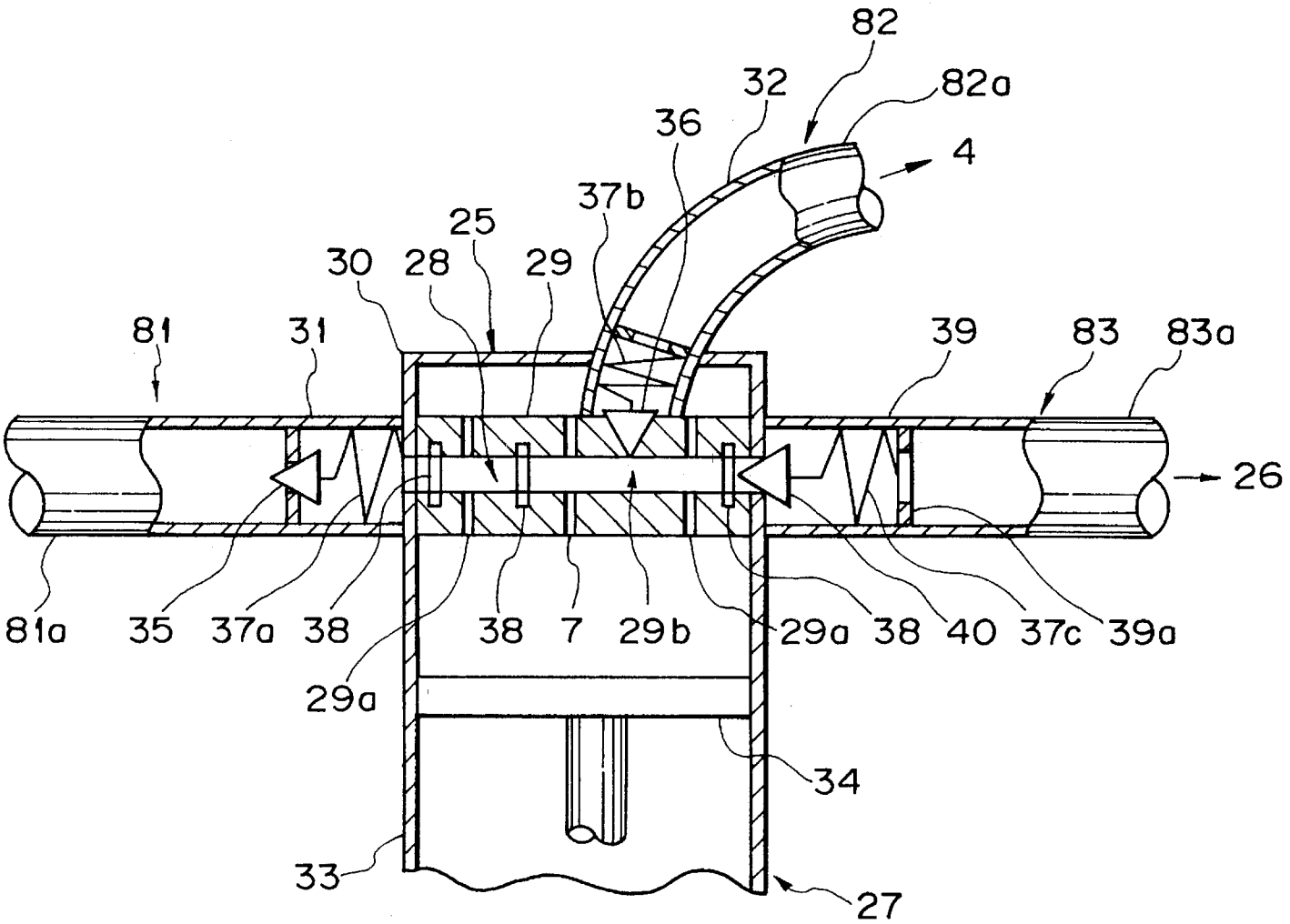

FIG. 22 shows another alternative embodiment of the present invention, particularly the transit receptacle 25. This embodiment is essentially similar to the eleventh embodiment except for the following. A plurality of filters 38 each having a different mesh size are located at suitable positions in the tubular element 29. A connecting tube 39 extends out from another opening formed through the transit receptacle 25. The tube 39 is communicated to a waste tube disposal tube 83*a* included in a third toner conveyor 83 which terminates at the waste toner container 26 and also uses a stream of air. A spring 37*c* is anchored at one end to a projection 39*a* provided on the inner wall of the connecting tube 39. The spring 37*c* biases a check valve 40 toward the storing portion 28. The toner conveyor 83 selects part of the collected toner in the receptacle 25 which should be discarded by the filters 38 and conveys it to the waste toner container 26.

In operation, when the piston 34 moves downward in the cylinder 33 as viewed in the figure, it sucks air out of the storing portion 28 of the tubular element 29 having the pores 29*a* and filters 38. At the same time, the check valve 35 on the suction side is opened against the action of the spring 37*a*. As a result, the toner from the cleaning unit 7 is sucked into and deposited on the element 29. When the piston 34 moves upward, air is blown into the element 29 under high pressure to open the check valve 36. As a result, part of the toner on the element 29 which has been passed through the filters 38 is conveyed from the transit receptacle 25 to the developing unit 4. On the other hand, the toner particles to be discarded are separated by the filters 38 and then transported to the waste toner container 26 via the check valve 40.

Figure 23A:
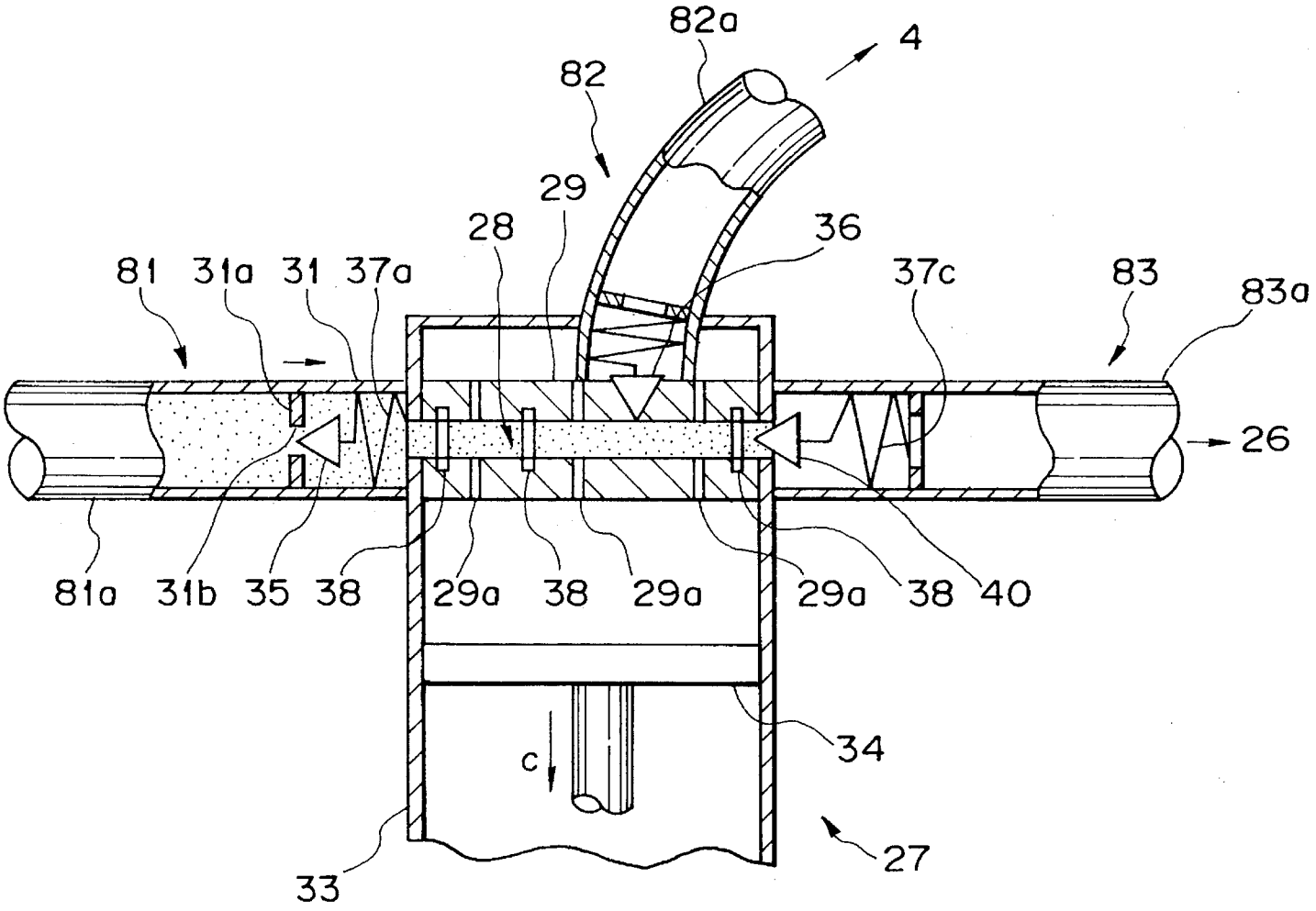
FIG. 23A and 23B demonstrate the operation of the embodiment shown in FIG. 22.
Figure 23B:
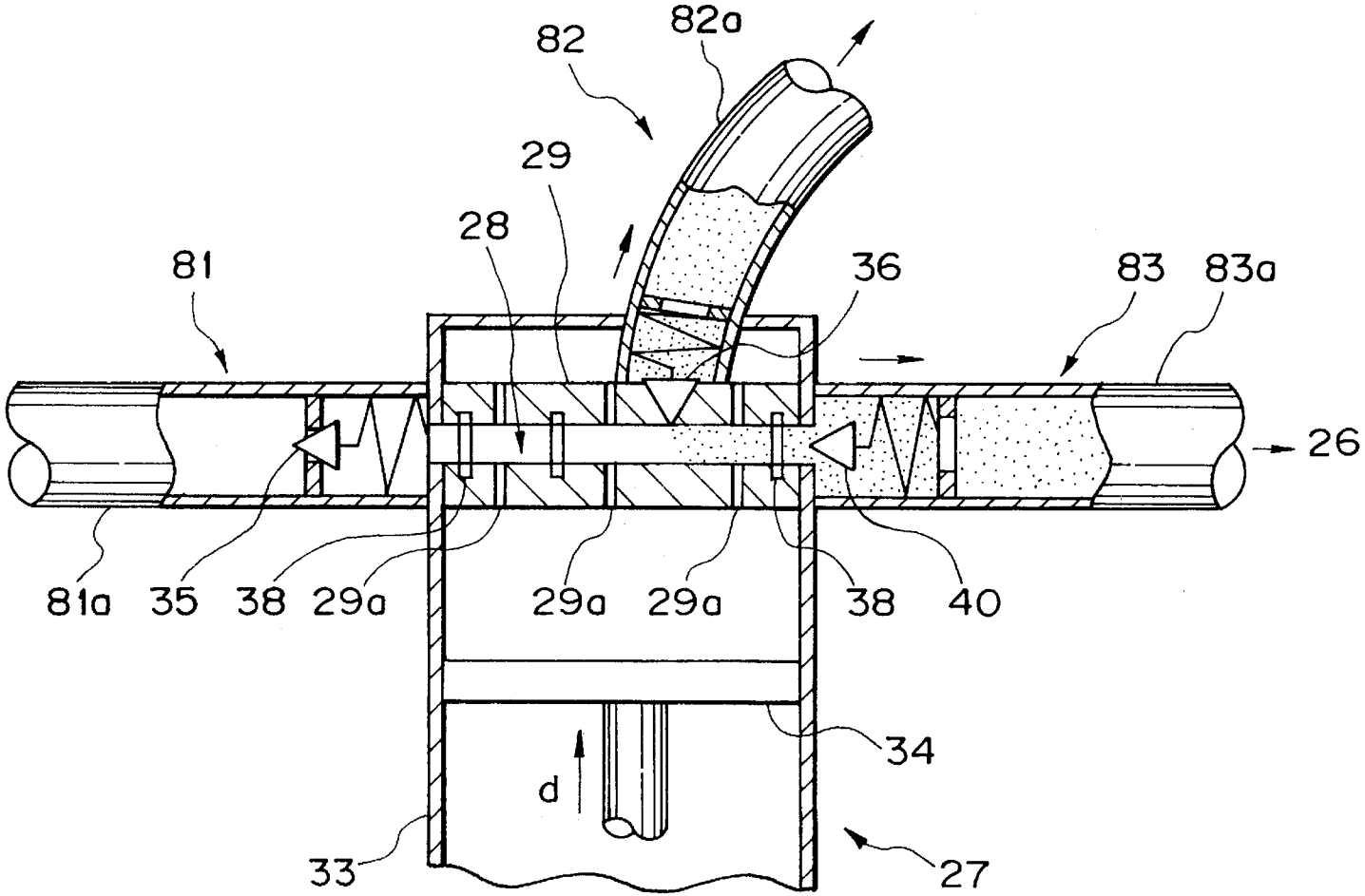

FIGS. 23A and 23B demonstrate the operation of the toner transport control section 27 included in the transit receptacle of FIG. 22 more specifically. As shown in FIG. 23A, as the piston 34 moves in the direction c in the cylinder 33, it sucks air out of the tubular element 29 having the pores 29*a* and filters 38 while opening the check valve 35 on the suction side. As a result, the collected toner from the cleaning unit 7 is sucked into and deposited on the tubular element 29. At this instant, the check valve 36 on the exhaust side and the check valve 40 on the disposal side remain closed. This suction occurs when the developing unit 4 is forming an image. The filters 38 disposed in the tubular element 29 are sequentially arranged in the decrementing order with respect to the mesh size from the suction side to the exhaust side. The filters 38 capture paper dust and other impurities existing in the collected toner and which should not be returned to the developing unit 4. As shown in FIG. 23B, as the piston 34 moves in the direction d, it blows air under high pressure into the storing portion 28. This stream of air removes the toner from the inner wall of the tubular element 29 while opening the check valve 40 on the disposal side. Consequently, the waste toner, i.e., fine toner particles (particle sizes less than 4μ), which would contaminate the background or be scattered around are caught by the filters 38 and then entrained to the toner container 26 by the air stream. Subsequently, the check valve 36 on the exhaust side is opened to transport the toner to be reused (particle sizes ranging from 4μ to 12μ) to the developing unit 4. This exhaust and disposal procedure is effected when the developing unit 4 is not forming an image. It is to be noted that when the continuous copy mode is not frequent, the suction, exhaust and disposal should preferably be effected when a copying operation is not under way.

To open the check valve 36 after the check valve 40 as stated above, the force of the spring 37*b* may be selected to be greater than that of the spring 37*c*. Among the plurality of filters 38, the filter closest to the disposal side has a mesh size small enough to pass only the fine toner particles to be discarded.

As stated above, the thirteenth embodiment discriminates undesirable toner particles from toner particles to be reused by the developing unit 4 by the filters 38 each having a different mesh size. This eliminates the local omission of an image in spots ascribable to the fine toner particles and prevents such toner particles from contaminating the background or from being scattered around, thereby insuring images stable despite the use of the collected toner.

[14th Embodiment]

Figure 24:
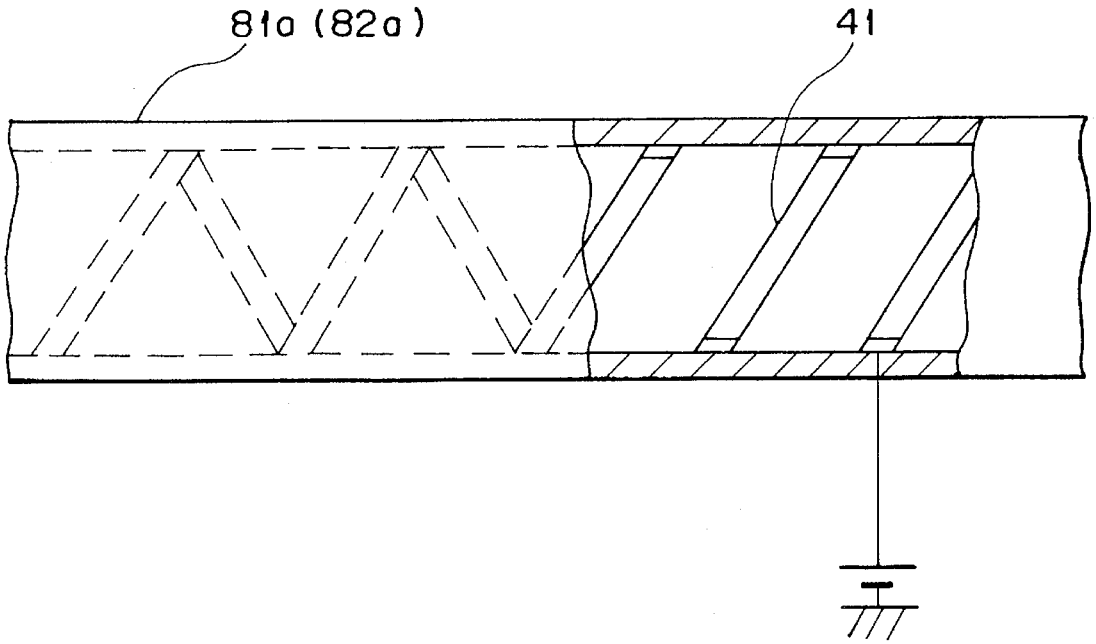
FIG. 24 and 25 are fragmentary sections each showing another alternative embodiment of the present invention.

FIG. 24 shows another alternative embodiment of the present invention, particularly a specific configuration of the suction tube 81*a* or the exhaust tube 82*a*. In this embodiment, the suction tube 81*a* or the exhaust tube 82*a* is made of an insulating material. An elastic electrolytic curtain 41 is spirally affixed to the inner wall of part of the tube and provided with a line-like or stripe-like configuration. A charge of the same polarity as the toner existing in the developing unit 4 is applied to the electrolytic curtain 41. The curtain 41, therefore, captures the inversely charged toner which would contaminate the background or be scattered around.

[15th Embodiment]

Figure 25:
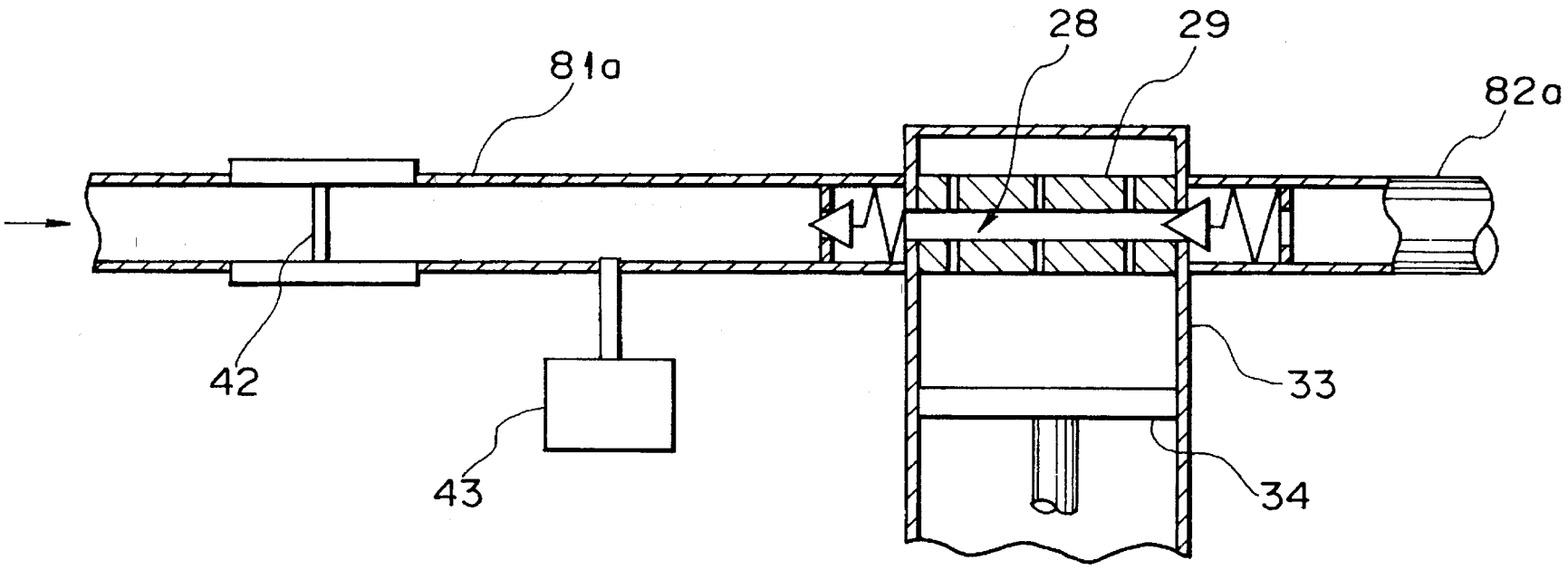

FIG. 25 shows another alternative embodiment of the present invention, particularly a specific configuration of the suction tube 81*a*. As shown, a mesh member 42 is provided on the tube 81*a* to serve as a filter. The mesh member 42 is provided with a relatively large mesh size so as to remove paper dust, masses of toner and so forth. Hence, the toner to be fed to the transit receptacle 25 is free from impurities and uniform in particle size, insuring stable images at all times. A flow meter 43 is disposed between the mesh member 42 and the transit receptacle 25. A flow rate is measured by the flow meter 43 beforehand when the mesh member 42 is clean. When impurities are deposited on the mesh member 42 to stop the member 42, the flow meter 43 detects the resulting decrease in flow rate. The flow rate and the change in flow rate are displayed by displaying means, not shown, to inform the operator of the time when the mesh member 42 will be stopped up. This allows the toner to be recycled stably at all times. Of course, the control for implementing the above procedure is executed by a controller, not shown.

The mesh member 42 may be provided with a replaceable configuration. When installed in a copier of the type producing only a small number of copies, the mesh member 42 does not have to be replaced since it will be rarely stopped up. However, when it comes to a copier of the type producing a great number of copies, the replaceable mesh member 42 is desirable in recycling the toner in a stable manner.

Figure 26:
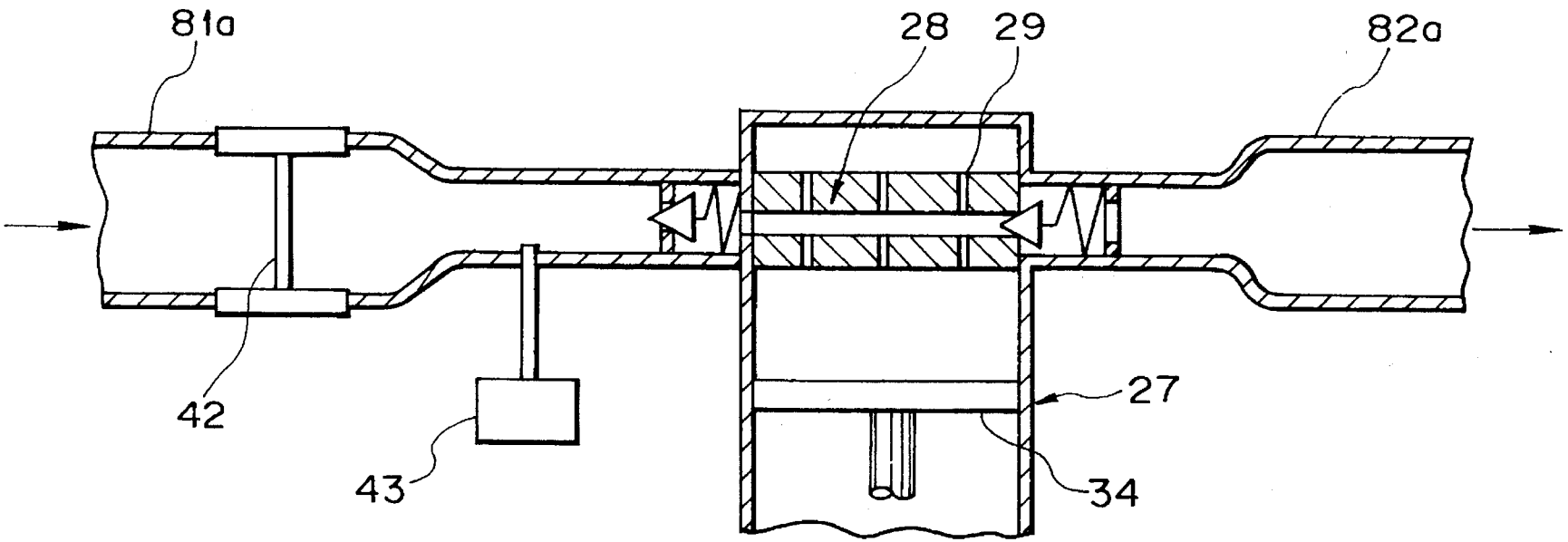
FIGS. 26 and 27 are fragmentary sections each showing a modified form of the embodiment shown in FIG. 25.
Figure 27:
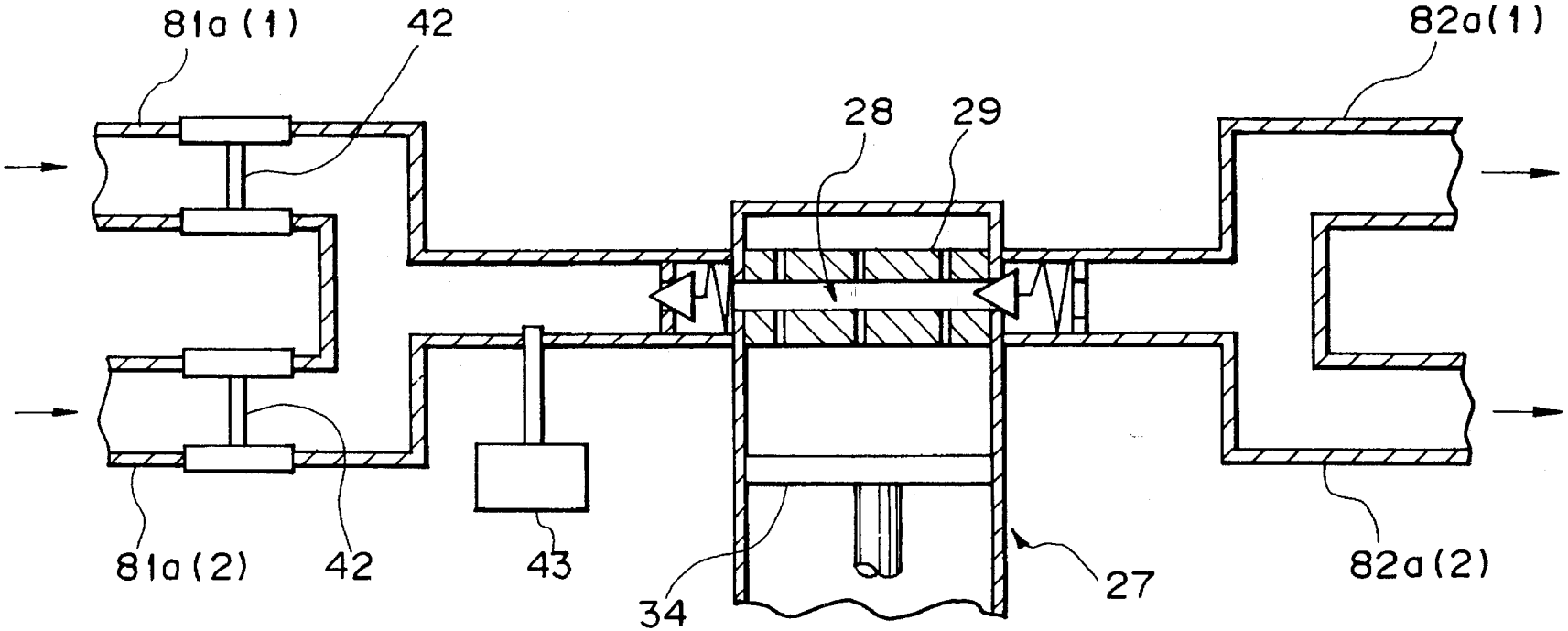

FIGS. 26 and 27 each show a particular modification of the fifteenth embodiment. The modification of FIG. 26 differs from the fifteenth embodiment in that the suction tube 81*a* and exhaust tube 82*a* are each provided with a greater diameter. The modification of FIG. 27 differs from the fifteenth embodiment in that the tubes 81*a* and 82*a* are each made up of a plurality of branches to increase the substantial inside diameter. In the modification of FIG. 26, the inside diameter of the tubes 81*a* and 82*a* is selected such that the mesh member 42 will not be stopped up by impurities before the preventive maintenance interval of the copier expires. As shown in FIG. 27, a plurality of suction tubes 81*a*(1), 81*a*(2)

and so forth and a plurality of exhaust tubes 82*a*(1), 82*a*(2) and so forth may be provided. While the mesh member 42 and flow meter 43 are shown as intervening between the suction tube 81*a* and the intermediate receptacle 25, they may, of course, be located at any other position between the cleaning unit 7 and the developing unit 4.

Various modifications will become possible for those skilled in the art after receiving the teachings of the present disclosure without departing from the scope thereof.

What is claimed is:

1. An image forming apparatus comprising:

developing means comprising a developing section for developing a latent image formed on an image carrier by depositing a toner on said latent image;

cleaning means for collecting the toner remaining on said image carrier;

toner storing means provided above said developing means for storing toner including both a fresh toner and the collected toner;

toner supplementing means for supplementing the toner from said toner storing means to said developing section of said developing means;

a first drive section for driving the toner supplementing means;

toner conveying means for conveying the collected toner to said toner storing means;

a second drive section for driving the toner conveying means; and control means for controlling the first and second drive sections associated with said toner supplementing means and said toner conveying means such that an amount of the toner fed from said toner storing means to said developing section and an amount of the collected toner conveyed to said toner storing means by said toner conveying means have a ratio lying in a predetermined range.

2. An apparatus as claimed in claim 1, wherein said toner conveying means comprises:

at least two conveying members extending between said cleaning means and said developing means and connected to each other; and a temporary toner storing section having a predetermined capacity and located at a position where said conveying members are connected to each other;

said control means controlling drive of one of said conveying means which is connected to said developing means and drive of said toner supplementing means.

3. An image forming apparatus comprising:

developing means comprising a developing section for developing a latent image formed on an image carrier by depositing a toner on said latent image;

cleaning means for collecting the toner remaining on said image carrier;

toner storing means provided above said developing means for storing toner including both a fresh toner and the collected toner;

toner supplementing means for supplementing the toner from said toner storing means to said developing section of said developing means;

a first drive section for driving the toner supplementing means;

toner conveying means for conveying the collected toner to said toner storing means;

blocking and unblocking means associated with an opening of said toner conveying means communicating to said developing means for selectively opening or closing said opening;

a second drive section for driving the blocking and unblocking means; and control means for controlling the first and second drive sections associated with said toner supplementing means and said blocking and unblocking means such that an amount of the toner fed from said toner storing means to said developing section and an amount of the collected toner conveyed to said toner storing means by said toner conveying means have a ratio lying in a predetermined range.

4. An image forming apparatus comprising:

developing means comprising a developing section for developing a latent image formed on an image carrier by depositing a toner on said latent image to thereby produce a toner image;

cleaning means for collecting a toner remaining on said image carrier after the toner image has been transferred to a transfer medium;

toner storing means provided above said developing means for storing a fresh toner;

fresh toner supplementing means for supplementing the fresh toner from said toner storing means to said developing section of said developing means;

a first drive section for driving the fresh toner supplementing means;

a collected toner storing means provided in said developing means independently of said toner storing means;

toner conveying means for conveying the collected toner collected by said cleaning means to said collected toner storing means;

collected toner supplementing means for supplementing the toner from said collected toner storing means to said developing means;

a second drive section for driving the collected toner supplementing means; and control means for controlling the first and second drive sections associated with said fresh supplementing means and said collected toner supplementing means such that a ratio of the collected toner to the entire toner existing in said developing section is lower than a predetermined ratio.

5. An image forming apparatus comprising:

developing means including a developing section for developing a latent image formed on an image carrier by depositing a toner on said latent image to thereby produce a corresponding toner image;

cleaning means for collecting the toner remaining on said image carrier after the toner image has been transferred to a transfer medium;

toner storing means provided above said developing means for storing toner including both a fresh toner and the collected toner;

toner conveying means for conveying the collected toner to said toner storing means;

developing ability sensing means for determining a developing ability of said developing means;

toner supplementing means capable of supplementing the fresh toner and the collected toner to the developing section included in said developing means; and condition setting means responsive to an output of said developing ability sensing means for setting a condition under which the fresh toner and the collected toner should be supplemented to control a ratio of a supply of fresh toner to collected toner such that contamination of a background, scattering of the toner and other undesirable occurrences are eliminated and a predetermined developing ability is maintained;

wherein said developing ability sensing means comprises:

switching means for selecting a predetermined image forming condition; and toner detecting means for determining an amount of the toner deposited on the latent image under said predetermined image forming condition selected by said switching means.

6. An image forming apparatus comprising:

developing means comprising a developing section for developing a latent image formed on an image carrier by depositing a toner on said latent image to thereby produce a corresponding toner image;

cleaning means for collecting the toner remaining on said image carrier after the toner image has been transferred to a transfer medium;

collected toner storing means for storing the collected toner;

toner conveying means for conveying the collected toner to said toner storing means;

first toner supplementing means including a first supplement member for supplementing the collected toner from the collected toner storing means to said developing section of said developing means;

fresh toner storing means for storing fresh toner;

second toner supplementing means including a second supplement member for supplementing the fresh toner from the fresh toner storing means to said developing section of said developing means; and control means for controlling the first and the second supplement member which feed respectively the collected toner and the fresh toner from said first toner supplementing means and said second toner supplementing means to said developing section, such that said first supplement member feeds a smaller amount of toner than said second supplement member.

* * * * *